US007131542B2

(12) United States Patent
Sedon et al.

(10) Patent No.: US 7,131,542 B2
(45) Date of Patent: Nov. 7, 2006

(54) LOCKABLE MERCHANDISE DISPLAY HOOK

(75) Inventors: Nicholas M. Sedon, Massillon, OH (US); Frank H. Copen, Shreve, OH (US)

(73) Assignee: Alpha Security Products, Inc., Charlotte, NC (US)

( * ) Notice: Subject to any disclaimer, the term of this patent is extended or adjusted under 35 U.S.C. 154(b) by 379 days.

(21) Appl. No.: 10/391,346

(22) Filed: Mar. 18, 2003

(65) Prior Publication Data

US 2004/0026344 A1 Feb. 12, 2004

Related U.S. Application Data

(60) Provisional application No. 60/365,635, filed on Mar. 18, 2002, and provisional application No. 60/449,101, filed on Feb. 20, 2003.

(51) Int. Cl.
*A47F 5/00* (2006.01)

(52) U.S. Cl. ..... 211/59.1; 211/57.1; 211/7

(58) Field of Classification Search ..... 211/4, 211/7, 57.1, 59.1, 54.1, 106, 106.1
See application file for complete search history.

(56) References Cited

U.S. PATENT DOCUMENTS

| | | | | |
|---|---|---|---|---|
| 1,695,517 | A | | 12/1928 | Waldbauer |
| 2,441,407 | A | | 5/1948 | Glavies |
| 2,868,390 | A | | 1/1959 | McCrone |
| 3,048,311 | A | | 8/1962 | Neuenfeldt |
| 3,472,385 | A | | 10/1969 | Shapiro et al. |
| 3,567,034 | A | | 3/1971 | Mozelsio |
| 3,581,905 | A | | 6/1971 | Shapiro |
| 3,610,423 | A | | 10/1971 | Parillo |
| 3,622,011 | A | | 11/1971 | Snow |
| 3,659,721 | A | | 5/1972 | Parillo |
| 3,735,875 | A | | 5/1973 | Parillo |
| 3,934,727 | A | | 1/1976 | Brefka |
| 3,993,195 | A | | 11/1976 | Caligiuri |
| 4,008,835 | A | | 2/1977 | Budzik |
| 4,109,795 | A | | 8/1978 | Konigsford et al. |
| 4,254,879 | A | | 3/1981 | Maule |
| 4,289,242 | A | | 9/1981 | Kenyon |
| 4,289,721 | A | | 9/1981 | Ishise |
| 4,300,690 | A | | 11/1981 | Thomas |
| 4,324,352 | A | | 4/1982 | Goldfarb et al. |
| 4,363,430 | A | | 12/1982 | Radlin |
| 4,462,497 | A | * | 7/1984 | Maule ..... 211/7 |
| 4,474,300 | A | | 10/1984 | Entis |
| 4,553,294 | A | | 11/1985 | Larsen |
| 5,009,334 | A | | 4/1991 | Bodkins |
| 5,011,054 | A | | 4/1991 | Mauffette |
| 5,012,997 | A | | 5/1991 | Hutchison |
| 5,018,627 | A | | 5/1991 | Moore |
| 5,027,622 | A | | 7/1991 | Hatch et al. |

(Continued)

FOREIGN PATENT DOCUMENTS

| | | |
|---|---|---|
| DE | 198 43 036 | 3/2000 |
| EP | 1199012 A1 | 4/2002 |
| FR | 2795294 A1 | 12/2000 |

*Primary Examiner*—Robert W. Gibson, Jr.
(74) *Attorney, Agent, or Firm*—Sand & Sebolt

(57) ABSTRACT

A merchandise display hook attaches to a display board and has a rod assembly from which items of merchandise are hung and a base assembly that moves relative to the rod assembly. The base may lock directly to the rod or to an inner base member attached to the rod. When locked, the display hook is locked to the display board. The display hook may include an end assembly that slides along and selectively locks to the rod assembly to allow or prevent removal and loading of the items of merchandise from and onto the rod assembly. The display hook may alternately include an anti-sweeping mechanism to prevent rapid removal of the items of merchandise from the rod assembly.

24 Claims, 41 Drawing Sheets

U.S. PATENT DOCUMENTS 5,082,215 A 1/1992 Hutchison
5,160,048 A 11/1992 Leyden et al.
5,251,757 A 10/1993 Relyea et al.
5,259,220 A 11/1993 Fredrickson
5,275,027 A 1/1994 Eklof et al.
5,348,167 A 9/1994 Jensen
5,407,170 A * 4/1995 Slivon et al. ..... 248/552
5,423,436 A 6/1995 Morrow
5,441,161 A * 8/1995 Merl ..... 211/57.1
5,485,930 A 1/1996 Rushing
5,597,150 A 1/1997 Stein et al.
5,624,040 A 4/1997 Hono
5,676,258 A 10/1997 Leyden et al.
5,689,978 A 11/1997 Eklof et al.
5,702,008 A 12/1997 Thalenfeld et al.
5,711,432 A 1/1998 Stein et al.
5,765,801 A 6/1998 Geiselman
5,823,358 A 10/1998 Leyden et al.
5,823,407 A 10/1998 Mayer et al.
6,003,685 A 12/1999 Malin
6,223,915 B1 5/2001 Waner
6,349,909 B1 * 2/2002 Zarrow et al. ..... 248/220.41
6,474,478 B1 11/2002 Huehner et al.
6,622,979 B1 * 9/2003 Valiulis ..... 248/220.42
6,659,291 B1 * 12/2003 Huehner et al. ..... 211/4
2001/0013567 A1 8/2001 Valiulis
2003/0029816 A1 2/2003 Huehner et al.

* cited by examiner

LOCKABLE MERCHANDISE DISPLAY HOOK

CROSS REFERENCE TO RELATED APPLICATIONS

This application claims priority from U.S. provisional patent application Ser. No. 60/365,635 filed Mar. 18, 2002 and U.S. provisional patent application Ser. No. 60/449,101 filed Feb. 20, 2003; the disclosures of which are incorporated herein by reference.

BACKGROUND OF THE INVENTION

1. Technical Field

The present invention relates generally to merchandise display hooks that are attached to a display board or a wire display rack. More particularly, the present invention relates to display hooks that either prevent the rapid removal of items of merchandise from the display hook or prevent removal of items of merchandise when the display hook is locked. Specifically, the present invention relates to display hooks that can be locked to a display board or wire rack to prevent the removal of the display hook from the display rack while also preventing the removal of merchandise from the display hook or preventing rapid removal of the merchandise. In this application, the term "locked" is defined as a condition that requires a key to change the condition from locked to unlocked. A locked connection is thus more secure than a latched condition.

2. Background Information

Items of merchandise are commonly displayed for sale on long protruding rods supported from peg board or slat board. These protruding rods are commonly referred to in the art as peg board hooks or slat board hooks. Similar rods may also protrude from a wire display rack for the same purpose. Usually, the items of merchandise are of a smaller range, such as batteries or small tools or other components. Such merchandise is an easy target for shoplifters because they can rapidly remove all the items from a display hook and remove the merchandise from the store without being detected. Alternately, the entire display hook with the merchandise can be removed from peg boards and the like if they are not locked thereon. Therefore, it is desired in the art to provide security hooks that prevent both the removal of the display hooks from the peg boards or wire racks and the rapid removal of items of merchandise from the display hooks.

BRIEF SUMMARY OF THE INVENTION

In one embodiment, the invention provides a lockable display hook wherein the base of the display hook locks directly to the rod of the display hook. The base is slides along the rod between locked and unlocked positions wherein the display hook may be removed from the support wall when the base is in the unlocked position. A spring-biased latch extends between the rod and base to lock the two elements together in the locked position.

Another aspect of the invention is a lockable end assembly that prevents merchandise from being removed from the display rod.

Another aspect of the invention is that the key used to unlock the base or the end assembly may be held in place on the base or end assembly in a hands-free condition allowing the user to load the device with both hands.

In another embodiment, the invention provides a base that is adapted to be used with a wire frame support structure. The base allows different desirable mounting configurations.

In another embodiment, the invention provides a lockable display hook having a rod that holds merchandise wherein the rod may pivot between locked and loading positions. The loading position allows merchandise to be loaded onto the rod quickly while the locked position limited the rapid removal of the merchandise.

In a further embodiment, the invention provides a base that pivots between the locked and unlocked positions.

BRIEF DESCRIPTION OF THE SEVERAL VIEWS OF THE DRAWINGS

Similar numbers refer to similar parts throughout the specification.

DETAILED DESCRIPTION OF THE INVENTION

Figure 1:
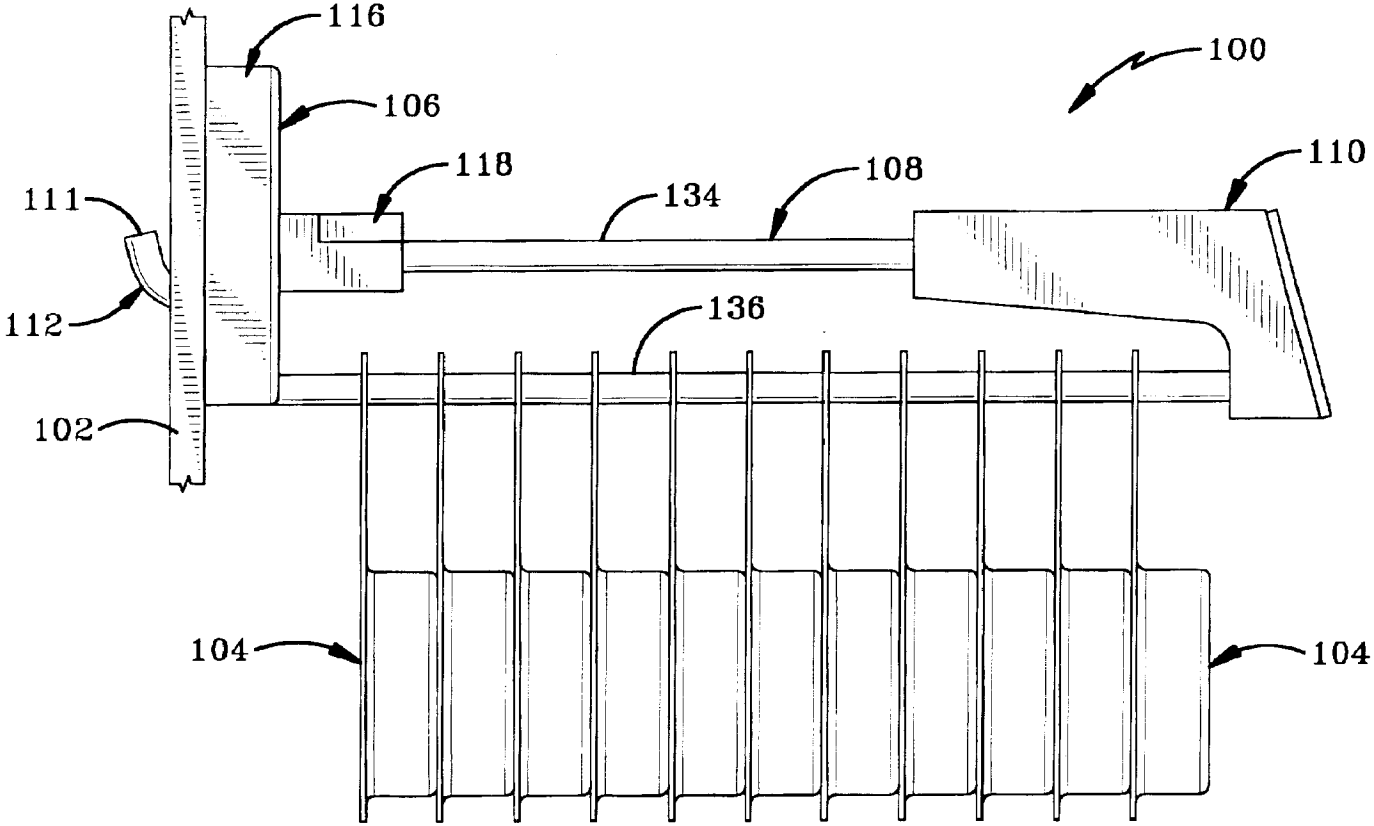
FIG. 1 is a side elevational view of a first embodiment of the merchandise display hook of the present invention connected to a display board and having items of merchandise hanging therefrom.
Figure 16:
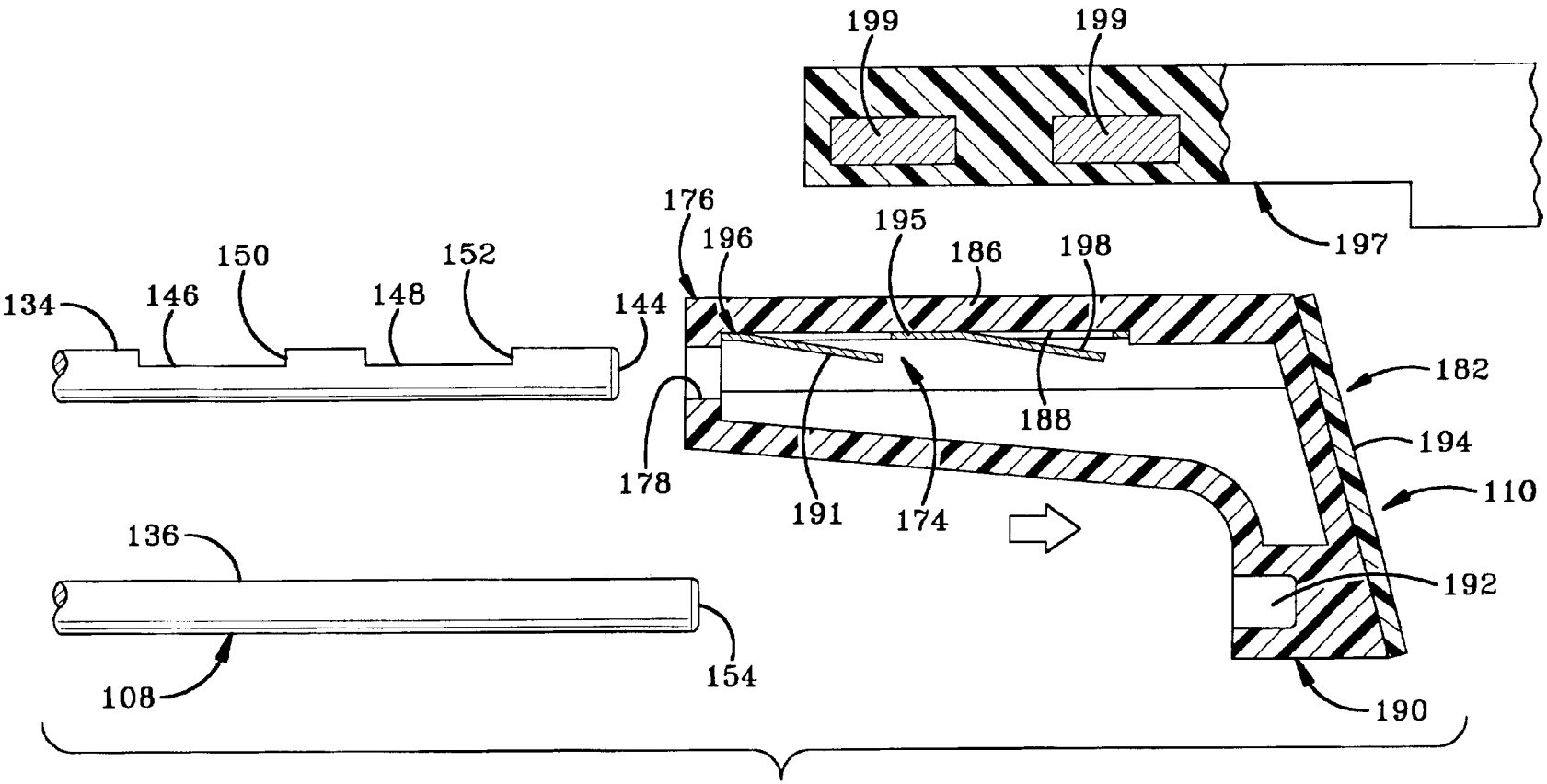
FIG. 16 is similar to FIG. 15 except the end assembly is completely removed from the rod assembly and the key is removed from the end assembly.
Figure 17:
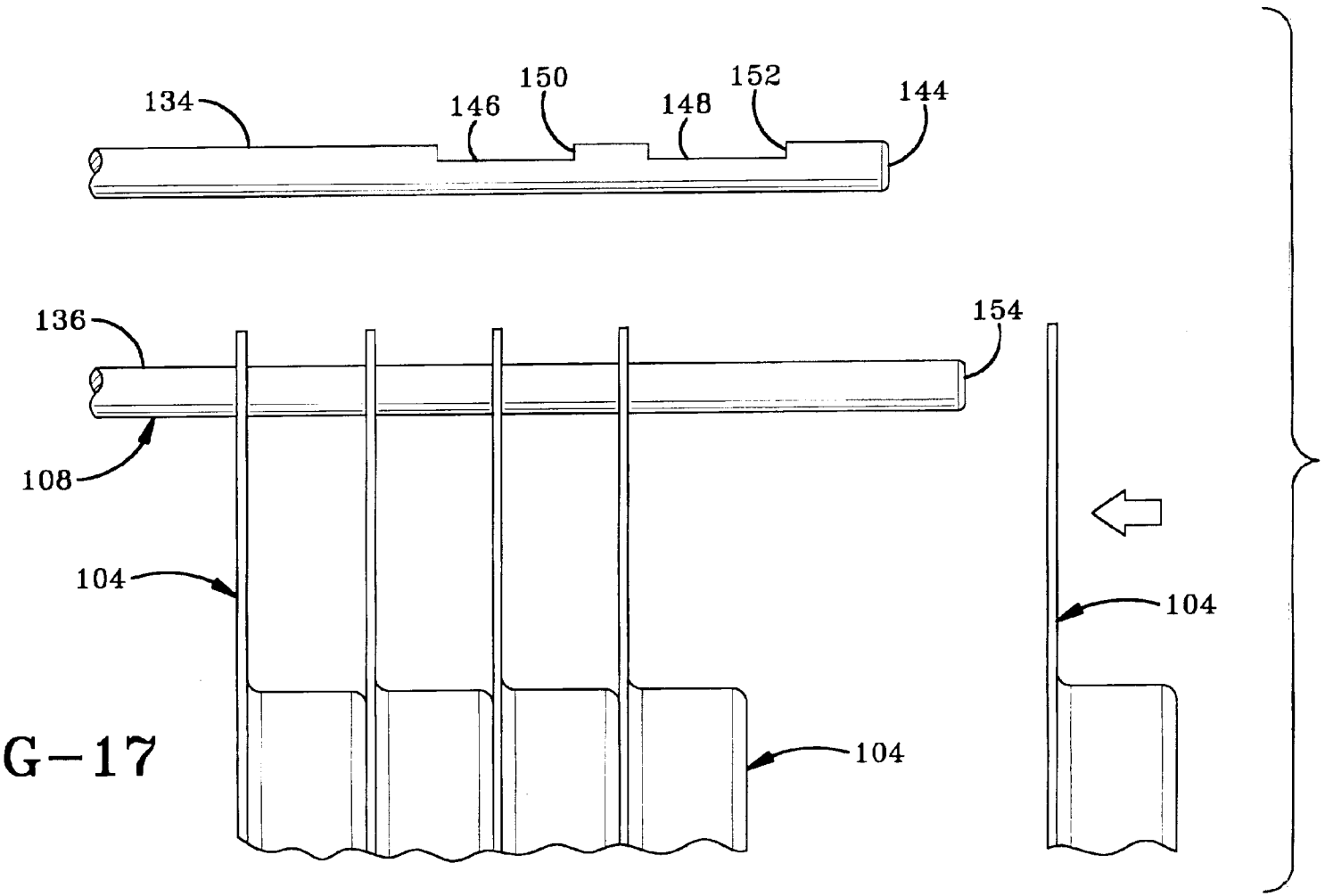
FIG. 17 is similar to FIG. 16 except it shows only the rod assembly with items of merchandise being loaded thereon.

The merchandise display hook of the present invention is indicated generally by the numeral 100 and is shown in FIGS. 1–20. Display hook 100 is used with a display board 102 (peg board or slat board) to support items 104 of merchandise for display in the retail environment. Display hook 100 holds multiple items 104 of merchandise to prevent their removal in a locked position (FIGS. 1 and 11) and allow removal of items 104 in an unlocked position (FIG. 17). Display hook 100 includes a base assembly 106, a rod assembly 108, an end assembly 110, 110A and a hook 112.

Figure 4:
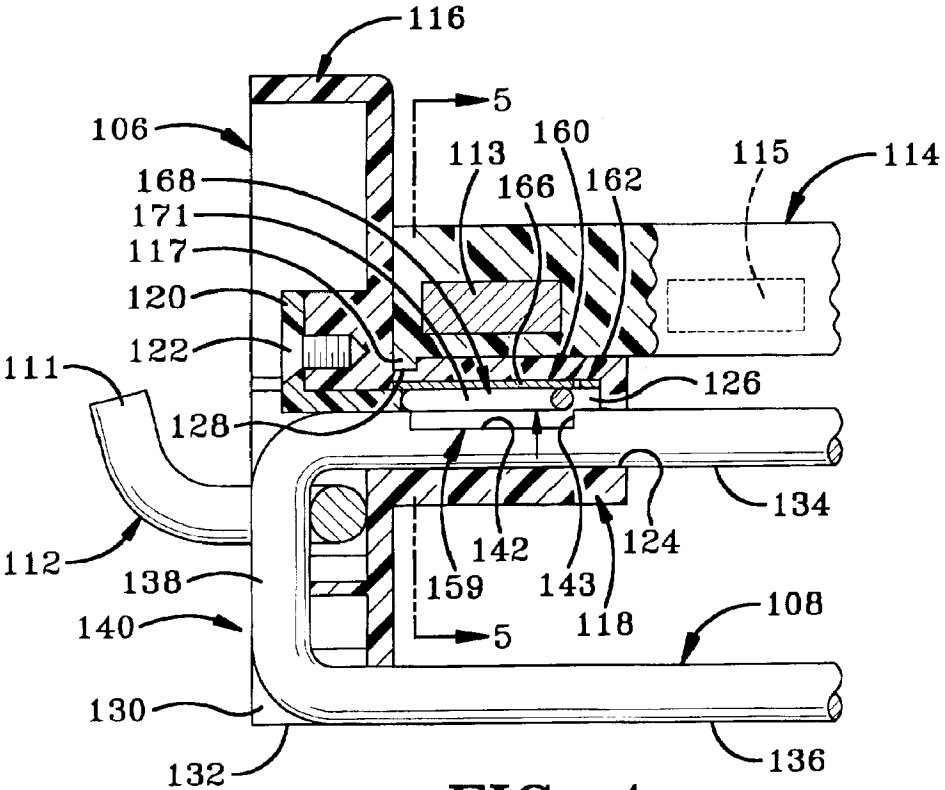
FIG. 4 is a sectional view similar to FIG. 3 showing an unlocked position with a key having unlocked the base assembly from the rod assembly.

Lockable base assembly 106 selectively secures display hook 100 to display board 102 in a manner that prevents display hook 100 from being removed from display board 102 without the use of a specific key 114 (FIG. 4). As used in this application, the term "locking" is different than a simple "latched" connection. A "latched" connection may be unlatched without the use of a special key while a "locked" connection requires a special key. Display board 102 includes a plurality of holes 103. Hook 112 includes a pair of upwardly extending ends 111. Key 114 includes a first magnet 113, a second magnet 115 and a protuberance 117. Base assembly 106 includes a foot 116 and a leg 118 extending outwardly therefrom. Leg 118 includes an upper wall 119. Base assembly 106 further includes chair member 120 which is connected to foot 116 by a screw 122, although this connection may be by any of a variety of connectors known in the art.

Leg 118 defines a hole 124 and an interior chamber 126 disposed above and communicating with hole 124. Interior chamber 126 is bounded on one end by a portion of chair member 120. Base assembly 106 further defines a recess 128 in leg 118 where leg 118 and foot 116 converge. Recess 128 receives protuberance 117 of key 114 as further described below. Base assembly 106 further defines a passage 130 adjacent a lower end 132 of foot 116.

A first embodiment of the rod assembly is shown generally at 108 and includes an upper rod 134 and a lower rod 136 joined by a connecting rod 138 adjacent an inner end 140 of rod assembly 108. Upper rod 134 defines an upwardly facing notch 142 adjacent inner end 140 of rod assembly 108. Notch 142 is bounded on one end by a ledge 143. Upper rod 134 is cylindrical and has an outer end 144 adjacent which upper rod 134 defines a pair of upwardly facing notches 146 and 148 having respective outer ledges 150 and 152. Lower rod 136 has an outer end 154 having a circular cross-section.

Figure 19:
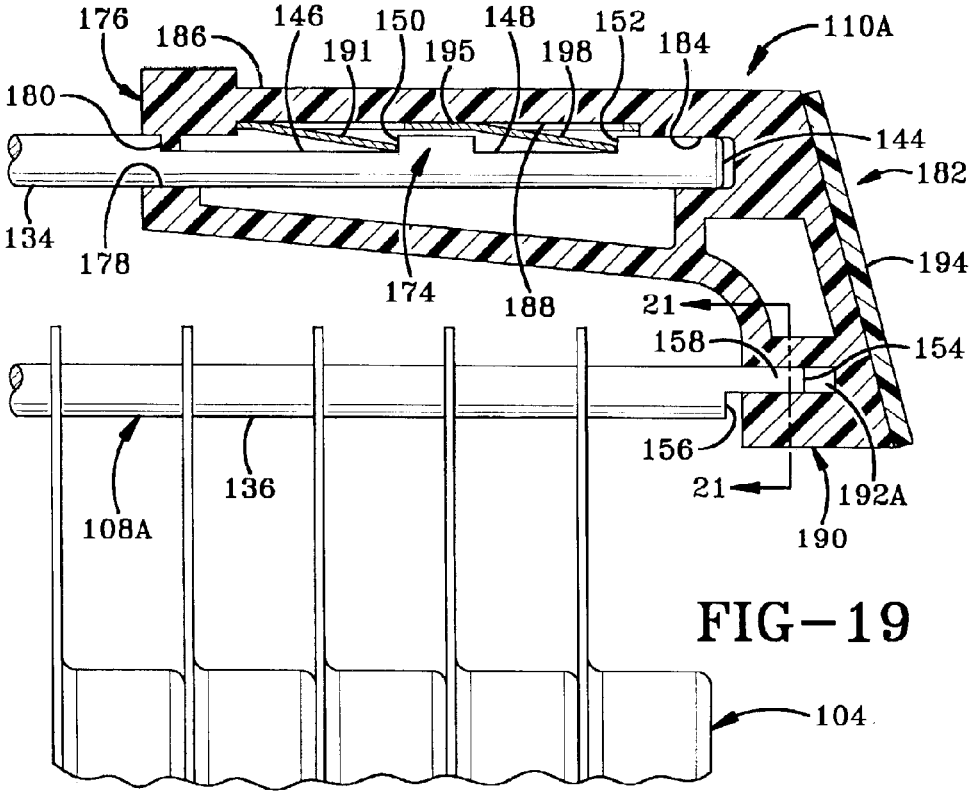
FIG. 19 is similar to FIG. 12 except it shows a modified embodiment of the end assembly in a locked position.
Figure 21:
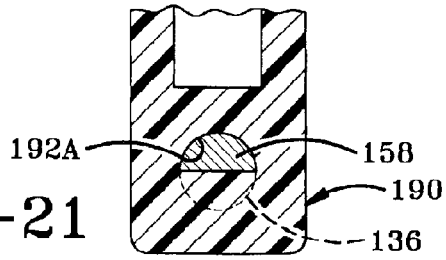
FIG. 21 is a fragmentary sectional view taken on line 21—21 of FIG. 19.
Figure 22:
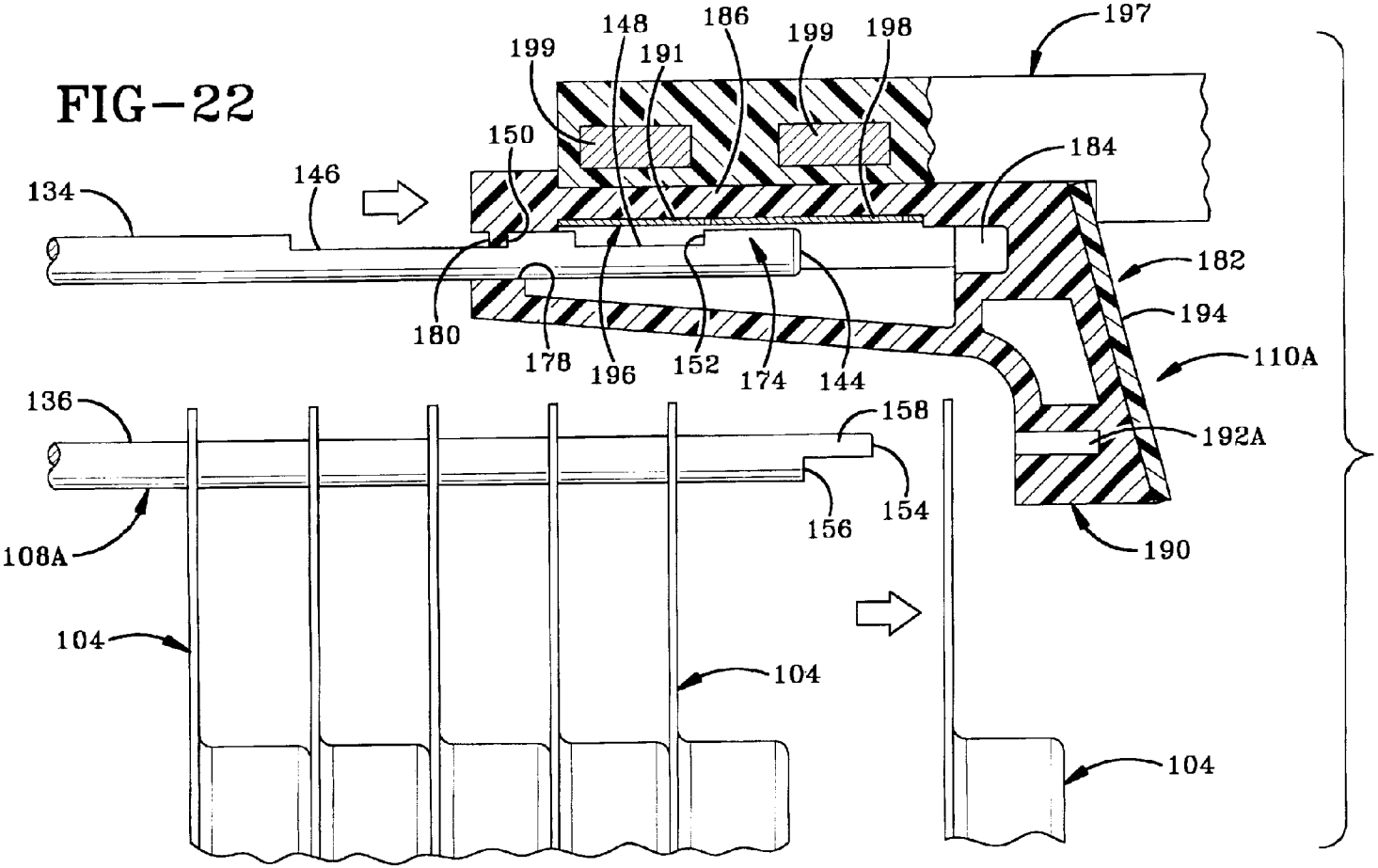
FIG. 22 is similar to FIG. 19 except a key is adjacent the end assembly and the end assembly is in an unlocked position and moved outwardly with an item of merchandise being removed from the rod assembly.

A second embodiment of the rod assembly is shown generally at 108A in FIGS. 19, 21 and 22. Rod assembly 108A differs from rod assembly 108 only in that adjacent outer end 154, lower rod 136 defines a downwardly facing notch 156 below a finger 158 having a semi-circular cross-section (FIG. 21).

A locking mechanism 159 disposed within base assembly 106 includes a locking finger assembly 160 which includes a spring element 162 having a base 164 and a finger 166 cantilevered from one end of base 164 and angling outwardly therefrom, being spring-biased in this outwardly angling position. Finger assembly 160 may optionally include a strengthening element 168 that includes a U-shaped portion 170 and a pair of wings 172 extending outwardly from a respective pair of arms 171 of the U-shaped portion 170.

The relationship between base assembly 106, rod assembly 108 and locking finger assembly 160 is as follows. Upper rod 134 slidably and lockably extends through hole 124 of base assembly 106 and lower rod 136 likewise slidably passes through passage 130 of base assembly 106. Finger assembly 160 is disposed within interior chamber 126 of leg 118 with spring element 162 lying adjacent upper wall 119 of leg 118 and strengthening element 168 being disposed below spring element 162. In a locked position (FIG. 11), wings 172 of strengthening element 168 are disposed within notch 142 of upper rod 134 with finger 166 of spring element 162 extending downwardly due to its spring bias toward notch 142. In an unlocked position (FIG. 4, 8–10), finger assembly 160 is disposed above notch 142 with no portion of assembly 160 extending into notch 142. Thus, in accordance with the invention, the lock mechanism in this embodiment directly engages rod 134 without the need for an inner base member to be mounted to rod 134.

A first embodiment of the end assembly is indicated generally at 110 and is depicted in FIGS. 12–18. End assembly 110 is used in conjunction with rod assembly 108. End assembly 110 may be completely removed from rod assembly 108. End assembly 110 includes a locking mechanism 174 adapted to lockably engage upper rod 134 in the locked position to prevent items 104 of merchandise for being removed from lower rod 136. End assembly 110 has a first end 176 adjacent which end assembly 110 defines a hole 178. End assembly 110 also has a second end 182 adjacent which is formed an opening 184. End assembly 110 includes an upper wall 186 which defines a recessed area 188 between hole 178 and opening 184. End assembly 110 further includes a lower portion 190 which defines an opening 192 which is substantially circular in cross-section. A display face 194 is disposed at second end 182 of end assembly 110. Locking mechanism 174 includes spring element 196 having a base 195 with an inner finger 191 and an outer finger 198 each extending downwardly from base 195 in the locked position. Locking mechanism 174 of end assembly 110 may be unlocked by a key 197 having a pair of magnets 199. The magnetic key may be the same as the key used for unlocking base assembly 106.

Figure 20:
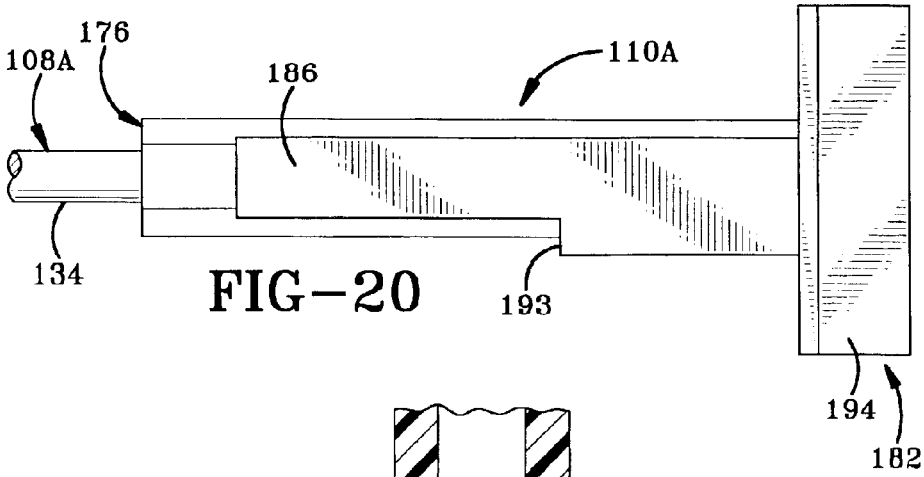
FIG. 20 is a fragmentary plan view of the modified embodiment of the end assembly.

A embodiment of the end assembly is indicated generally at 110A and is shown in FIGS. 19–22. End assembly 110A is used in conjunction with rod assembly 108A. End assembly 110A is similar to end assembly 110 except as noted below. End assembly 110A includes a projection 180 which narrows hole 178 and prevents the removal of end assembly 110A from rod assembly 108. Instead of the circular opening 192 formed in end assembly 110, end assembly 110A defines an opening 192A which is substantially semi-circular in cross-section (FIG. 21). Upper wall 186 of end assembly 110A further includes a ledge 193 (FIG. 20).

Figure 8:
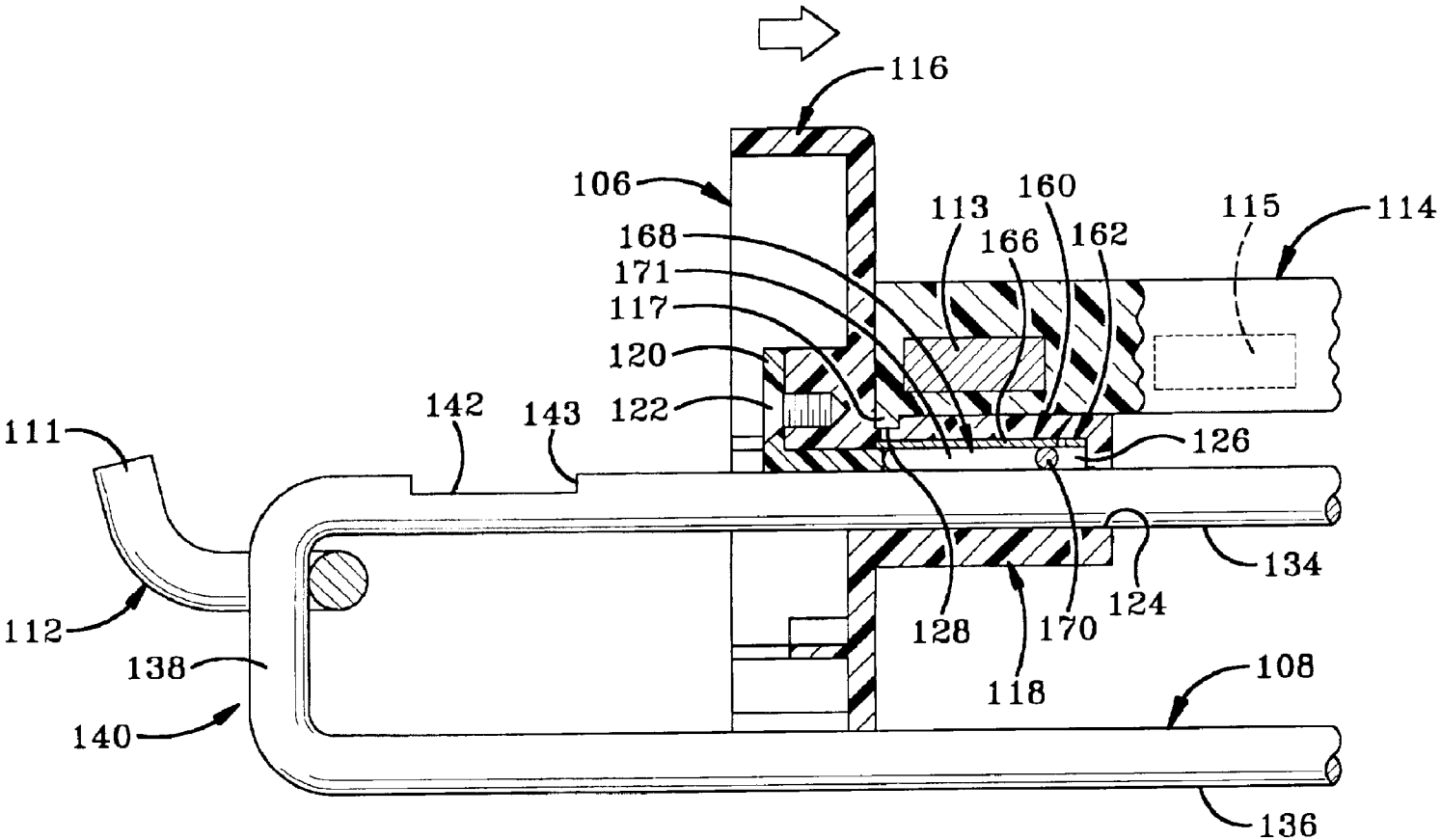
FIG. 8 is a fragmentary sectional view of the first embodiment showing the rod assembly and the base assembly in an unlocked position with the base assembly slid outwardly along the rod assembly.
Figure 9:
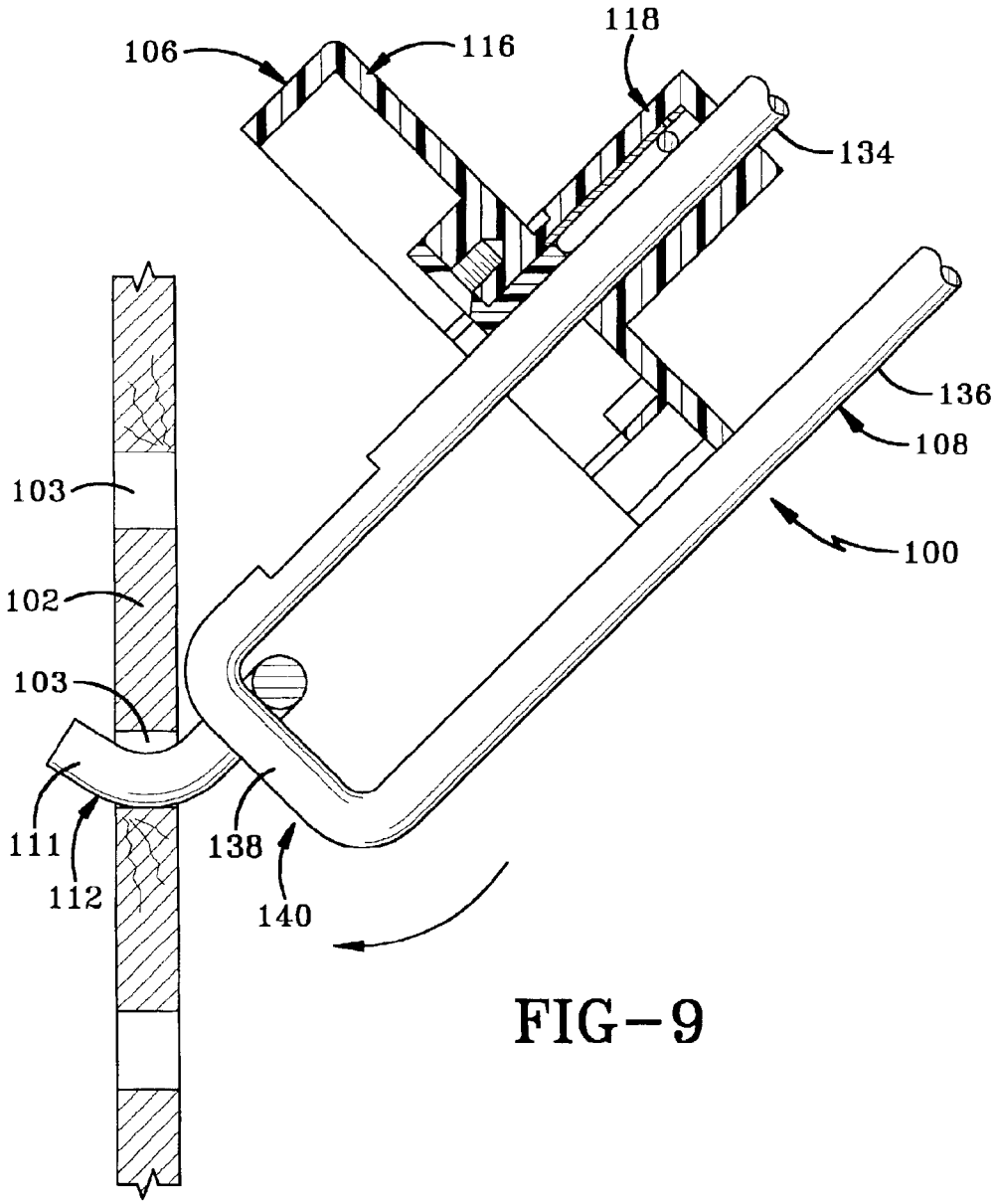
FIG. 9 is a fragmentary sectional view of the first embodiment as viewed from the side in an initial stage of connecting the display hook to the display board.
Figure 10:
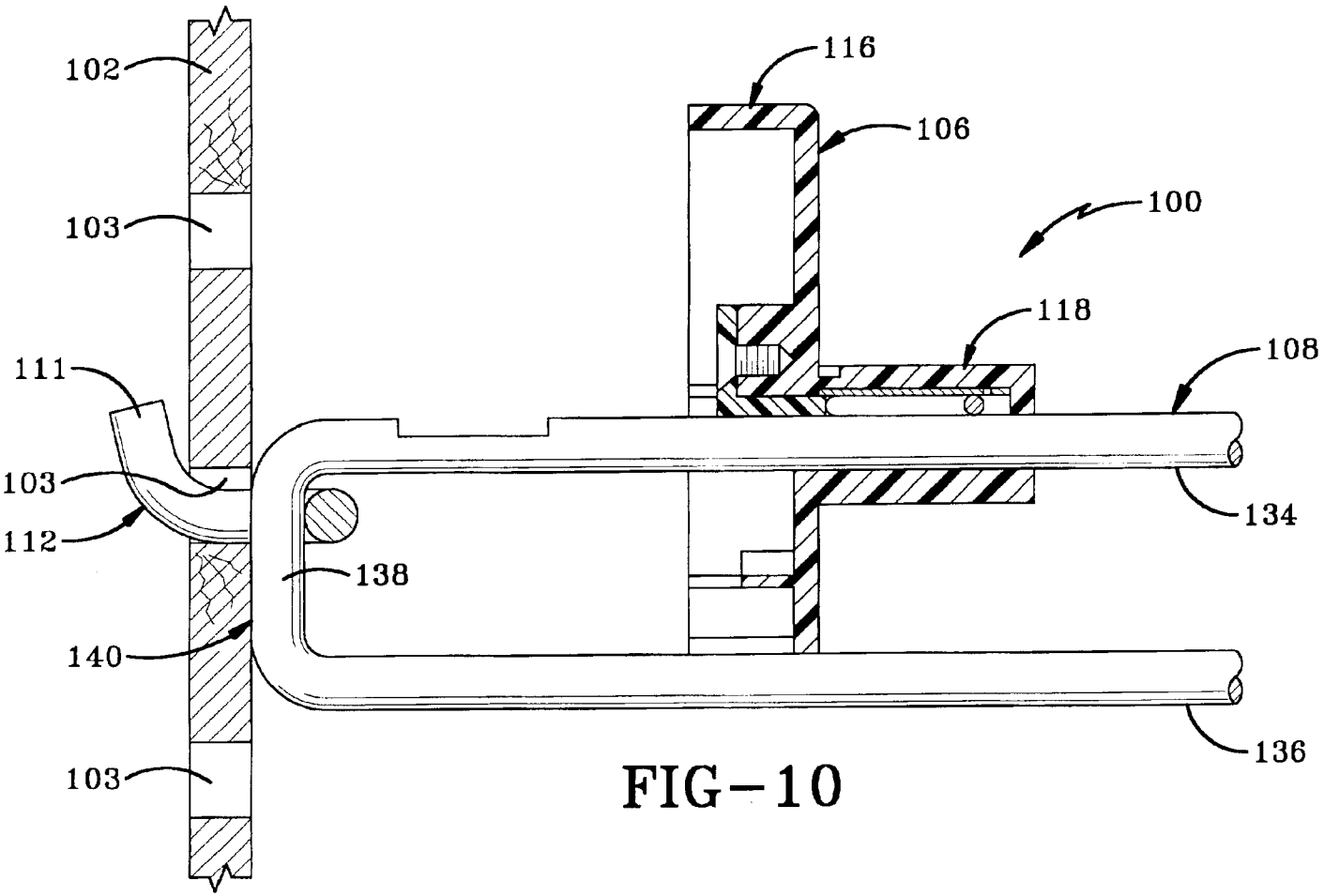
FIG. 10 is a fragmentary sectional view similar to FIG. 9 with the display hook connected to the display board.
Figure 11:
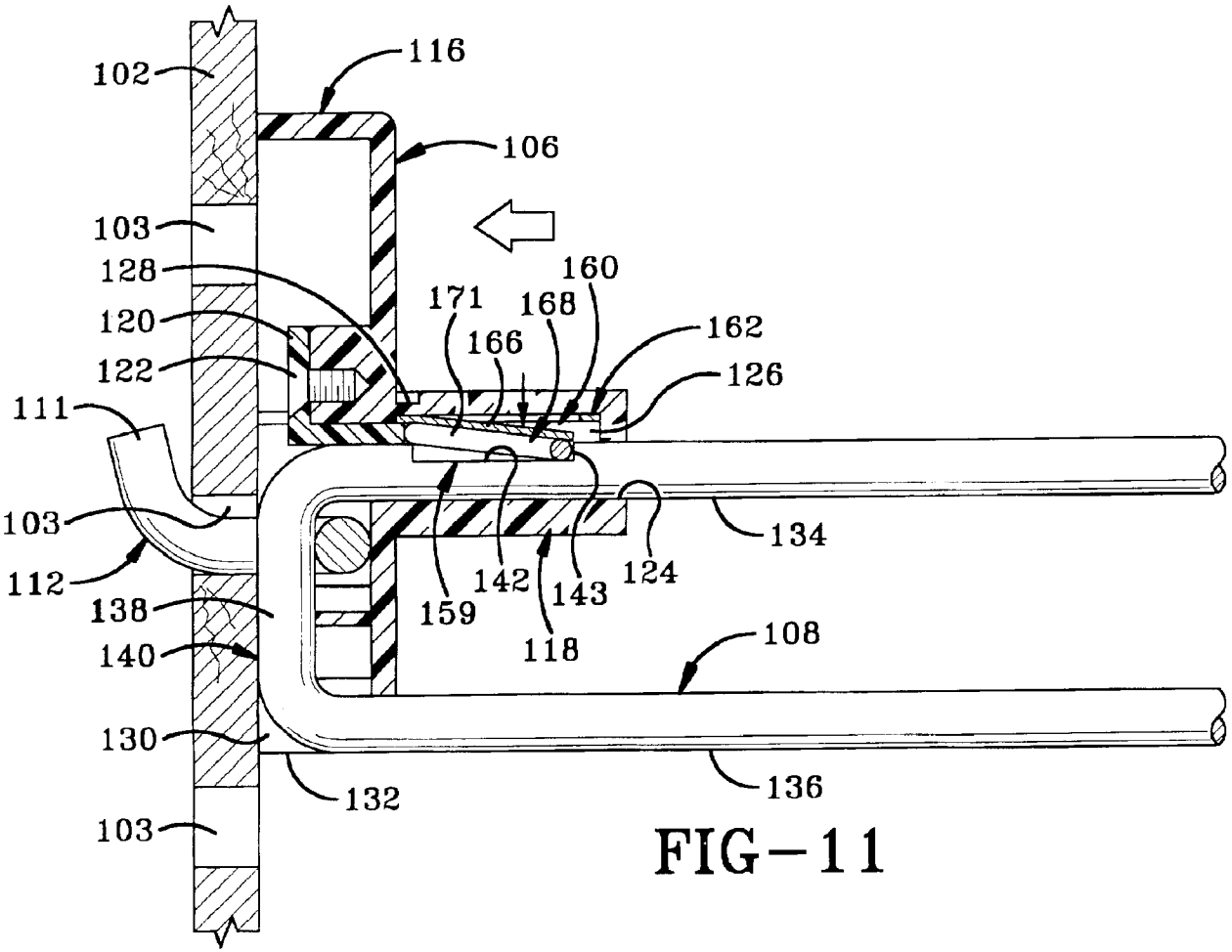
FIG. 11 is similar to FIG. 10 except that the base assembly has been slid into the locked position to lock the display hook to the display board.

In operation, merchandise display hook 100 is configured to attach to display board 102, as shown in FIGS. 9–11. To attach display hook 100 to display board 102, rod assembly 108 must be angled upwardly and outwardly with respect to display board 102 so that upwardly extending ends 111 of hook 112 may be inserted through holes 103 in display board 102 as shown in FIG. 9. To allow display hook 100 to angle upwardly to insert ends 111 through holes 103, base assembly 106 must be moved outwardly from hook 112. In accordance with the present invention, display hook 100 permits this outward movement because base assembly 106 in an unlocked position may slide outwardly along rod assembly 108, as shown in FIG. 8. Once hook 112 is inserted through holes 103 in display board 102, as shown in FIG. 10, rod assembly 108 extends generally horizontally outwardly from display board 102 with connecting rod 138 abutting display board 102. To lock display hook 100 to display board 102, base assembly 106 slides inwardly toward display board 102 into a locked position, as shown in FIG. 11.

Figure 3:
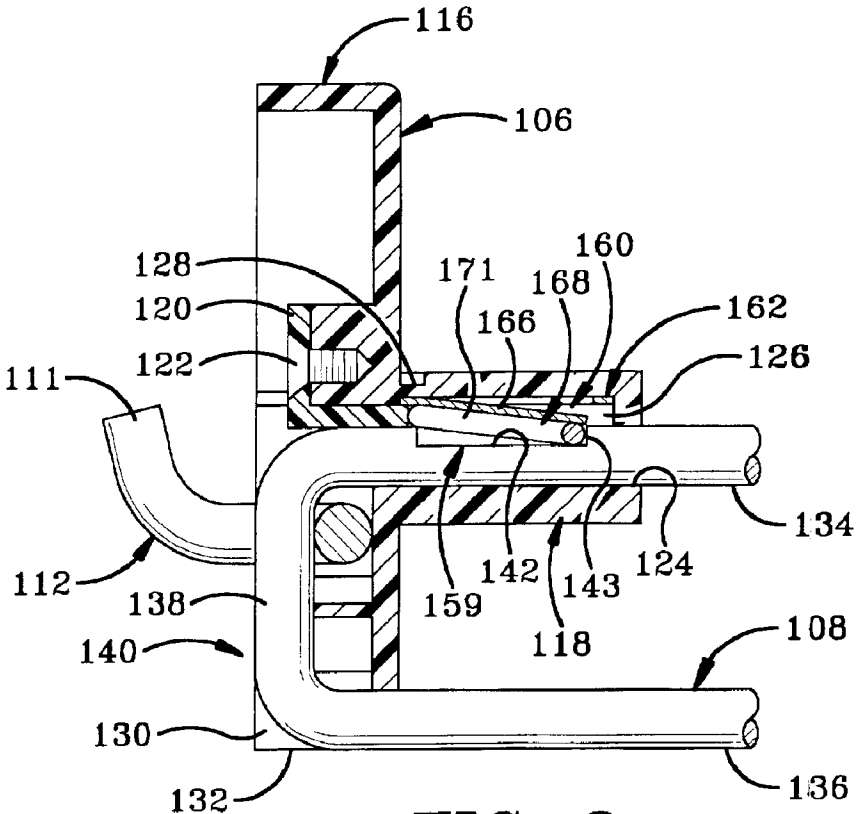
FIG. 3 is a fragmentary sectional view taken from the side showing the rod assembly and the base assembly in a locked position.
Figure 2:
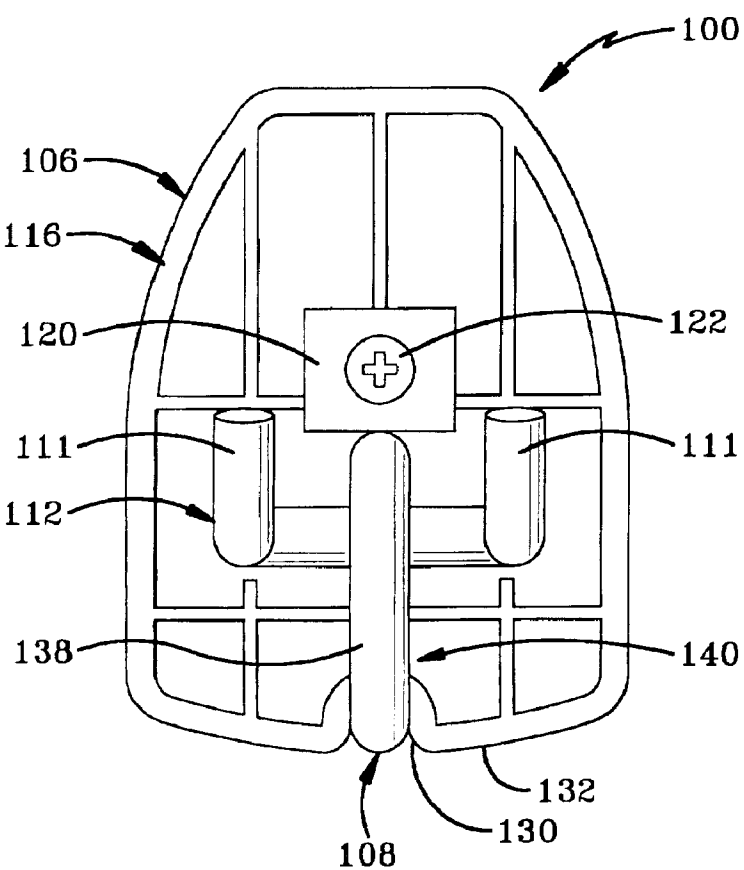
FIG. 2 is a rear elevational view of the first embodiment.
Figure 5:
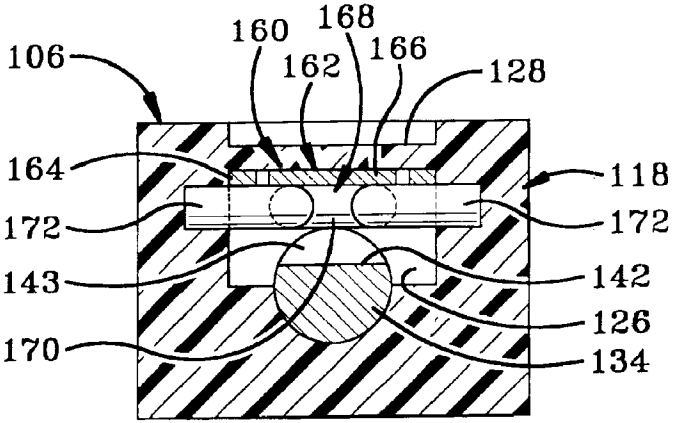
FIG. 5 is a sectional view taken on line 5—5 of FIG. 4.
Figure 7:
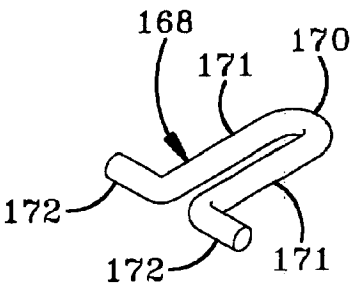
FIG. 7 is a perspective view of the strengthening element of the locking mechanism of the first embodiment.
Figure 6:
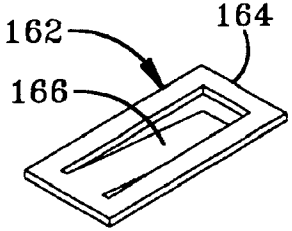
FIG. 6 is a perspective view of the spring element of the base assembly locking mechanism of the first embodiment.

The locked position of base assembly 106 is shown in FIG. 3, wherein finger 166 of spring element 162 is spring-biased to extend downwardly from base 164 and press wings 172 of strengthening element 168 into notch 142 to engage ledge 143. In the locked position, U-shaped portion 170 of strengthening element 168 abuts chair member 120 and wings 172 abut ledge 143 to prevent base assembly 106 from sliding outwardly along rod assembly 108. In alternative embodiments, the end of element 162 engages ledge 143 to lock base assembly 106 in place. Thus, display board 102 is lockedly sandwiched between hook 112 and base assembly 106 so that hook assembly 100 may not be lifted upwardly to the position shown in FIG. 9 to remove hook assembly 100 from display board 102. In the locked position, base assembly 106 cannot rotate about upper rod 134, which rotation would cause finger 166 and strengthening element 168 to rotate out of notch 142 and thus unlock locking mechanism 159. To prevent the rotation of base assembly 106 about upper rod 134 in the locked position, base assembly 106 engages connecting rod 138 about passage 130 of base assembly 106. Base assembly 106 may also engage rod 136 to prevent rotation. When a single rod is used, rotation of base assembly 106 may be limited by using a rod with a non-circular cross section in conjunction with a complementary hole 124 in base assembly 106 would also prevent the rotation of base assembly 106 about upper rod 134.

To unlock locking mechanism 159 of base assembly 106, key 114 having a magnet 113 encased therein is placed adjacent leg 118 above spring element 162 and strengthening element 168, thereby attracting finger 166 of spring element 162 and strengthening element 168 upwardly out of notch 142, as shown in FIG. 4. With strengthening element 168 removed from notch 142, base assembly 106 is in the unlocked position and free to slide along rod assembly 108. Once base assembly 106 has moved along rod assembly 108 to the extent that wings 172 of strengthening element 168 are no longer above notch 142, the magnetic key 114 may be removed and base assembly 106 is able to slide along rod assembly 108 without the use of key 114. It is noted that only the first magnet 113 of key 114 is needed to unlock locking mechanism 159, but both first magnet 113 and second magnet 115 may be used to unlock locking mechanism 174 of end assembly 110, 110A, as described further below.

To facilitate pulling base assembly 106 outwardly along rod assembly 108, protuberance 117 of key 114 engages recess 128 of base assembly 106. In addition, the magnetic aspect of key 114 allows it to hold itself to base assembly 106 above spring elements 162 and strengthening element 168 while base assembly 106 is moved along rod assembly 108. Thus, a user may manipulate base assembly 106 without needing to hold on to key 114 or put it down somewhere during this process.

In accordance with the present invention, each end assembly 110, 110A slides along rod assembly 108 and 108A, respectively, and has a locking mechanism 174 to selectively lock end assembly 110, 110A to upper rod 134. Locking mechanism 174 utilizes a spring element similar to spring element 162 in base assembly 106. However, the preferred embodiment of end assembly 110, 110A includes a pair of fingers, namely inner finger 191 and outer finger 198 of spring element 196, to engage respective notches 146 and 148 of upper rod 134. As no strengthening element is used as with locking mechanism 159 in base assembly 106, the use of a pair of fingers adds strength to locking mechanism 174. Magnetic key 197 is used to unlock locking mechanism 174 as described in relation to base assembly 106 except, as noted, there is no strengthening element 168 involved. Locking mechanism 174 of end assembly 110, 110A and locking mechanism 159 of base assembly 106 may be opened by a common key. Like key 114 used with locking mechanism 159 of base assembly 106, the magnetic aspect of key 197 allows key 197 to hold itself to end assembly 110 or 110A above spring elements 162 while end assembly 110 or 110A is moved along rod assembly 108 or 108A, respectively. This allows a user to manipulate end assembly 110 or 110A without having to hold on to key 197 or put key 197 down somewhere while loading items 104 of merchandise onto lower rod 136. In a locked position shown in FIG. 12, fingers 198 engage ledges 150 and 152 to prevent end assembly 110 from sliding toward outer end 144 of upper rod 134. FIG. 19 shows the same finger-ledge engagement in the locked position of end assembly 110A.

Figure 12:
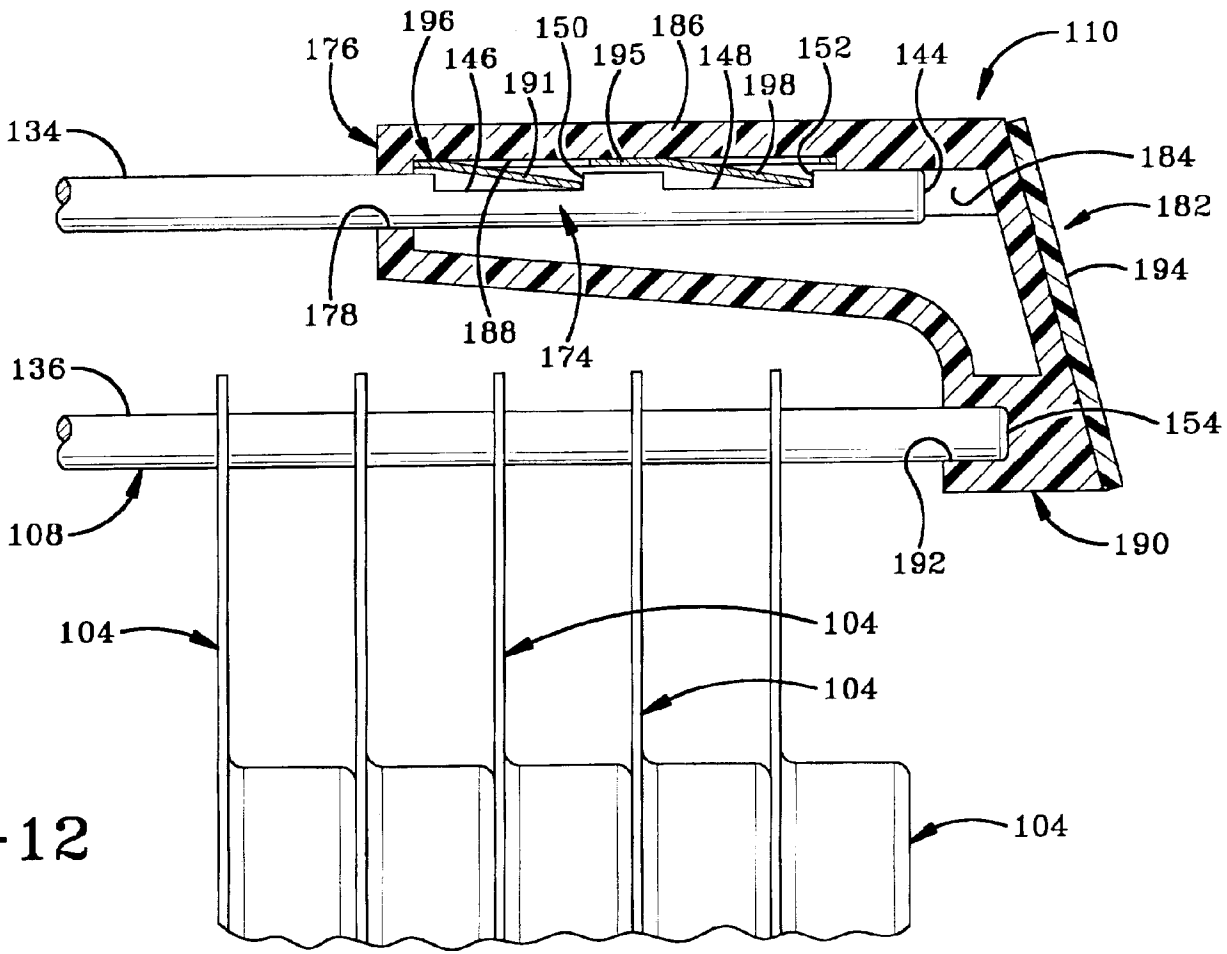
FIG. 12 is a fragmentary sectional view of the first embodiment of the present invention as viewed from the side showing a first embodiment of the end assembly in a locked position.
Figure 13:
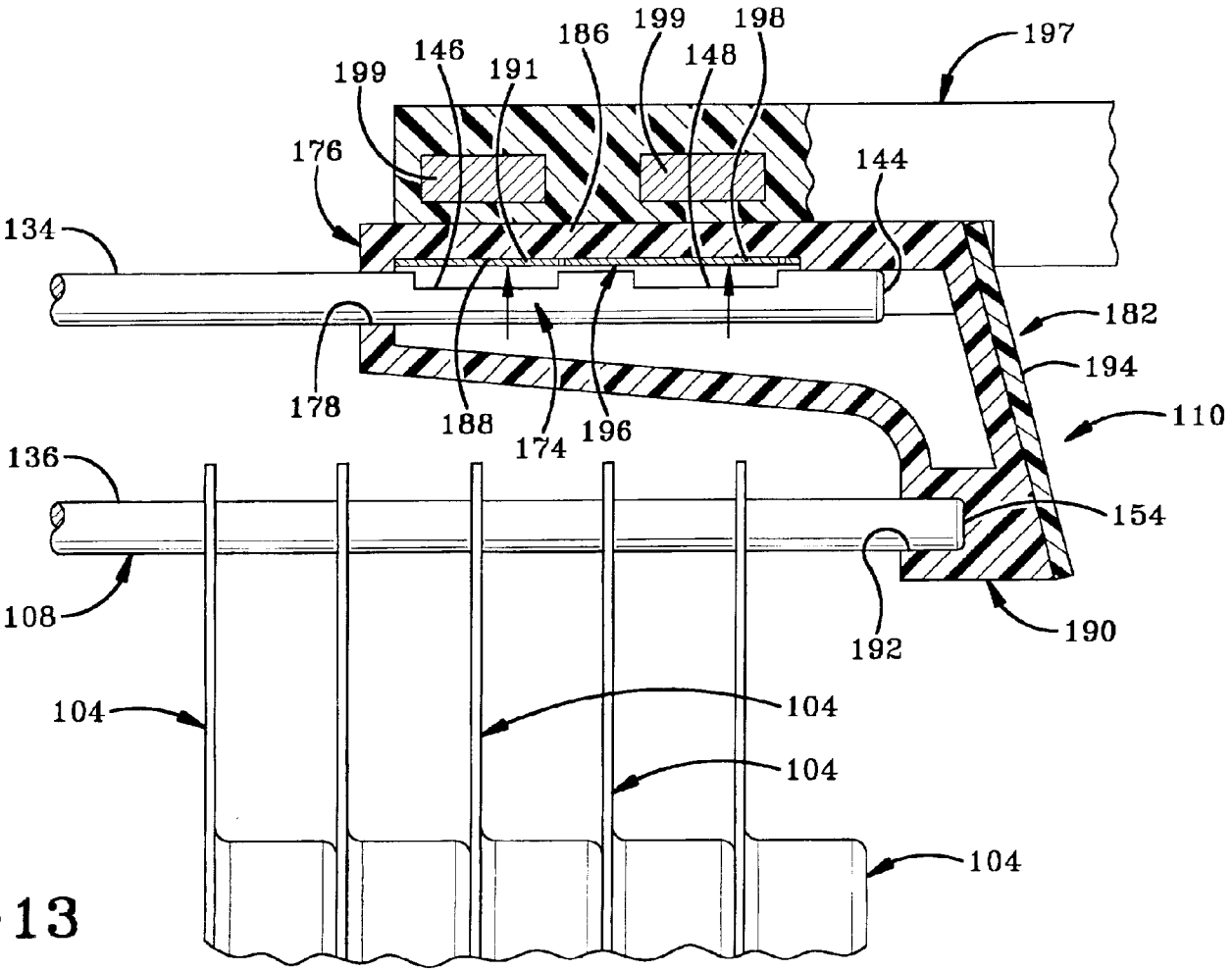
FIG. 13 is similar to FIG. 12, but shows a key adjacent the end assembly and the end assembly in an unlocked position.
Figure 14:
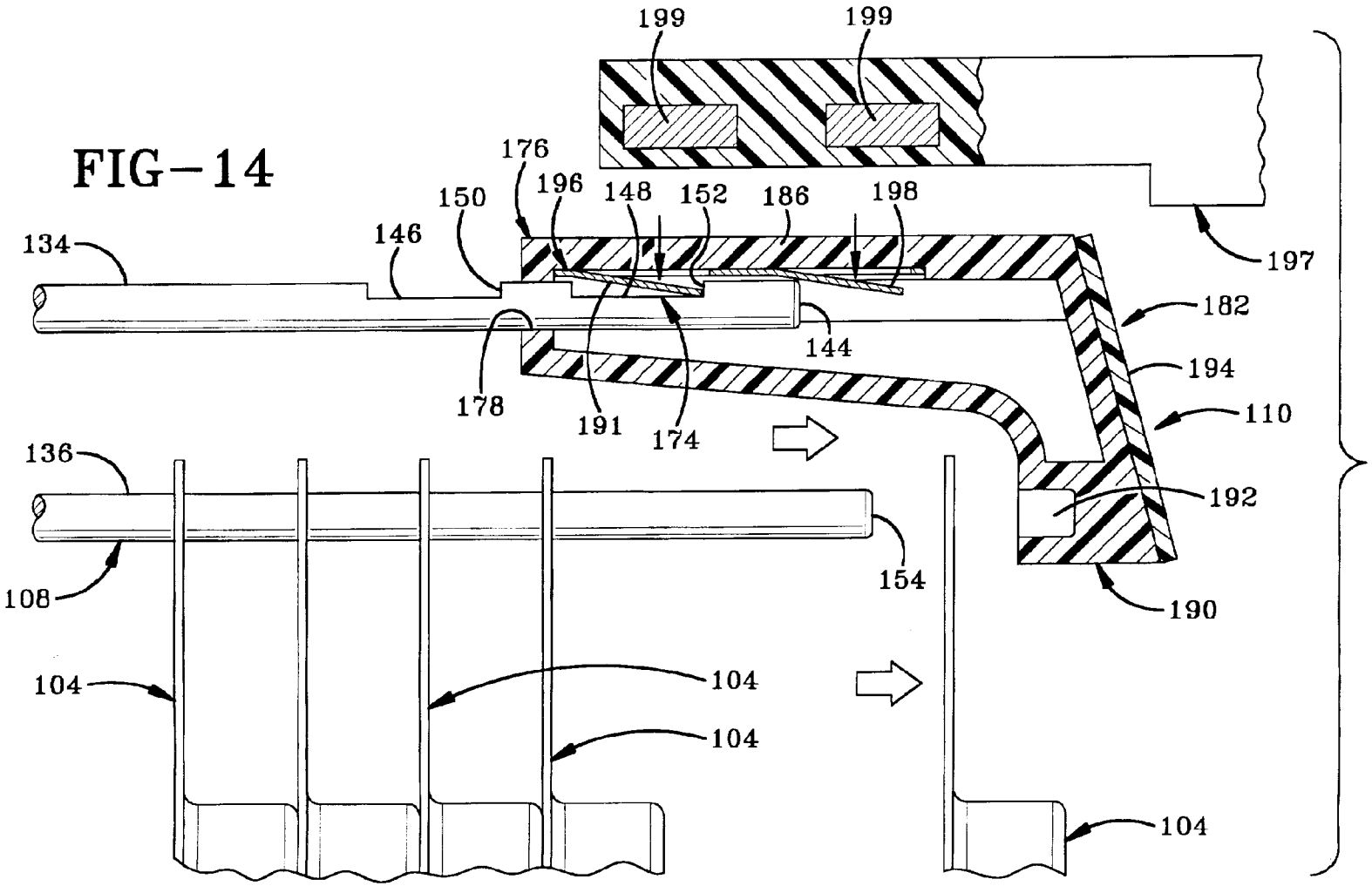
FIG. 14 is similar to FIG. 13, but shows the key removed and the end assembly moved outwardly to an intermediate position with the locking mechanism partially engaged and with an item of merchandise being removed from the rod assembly.
Figure 15:
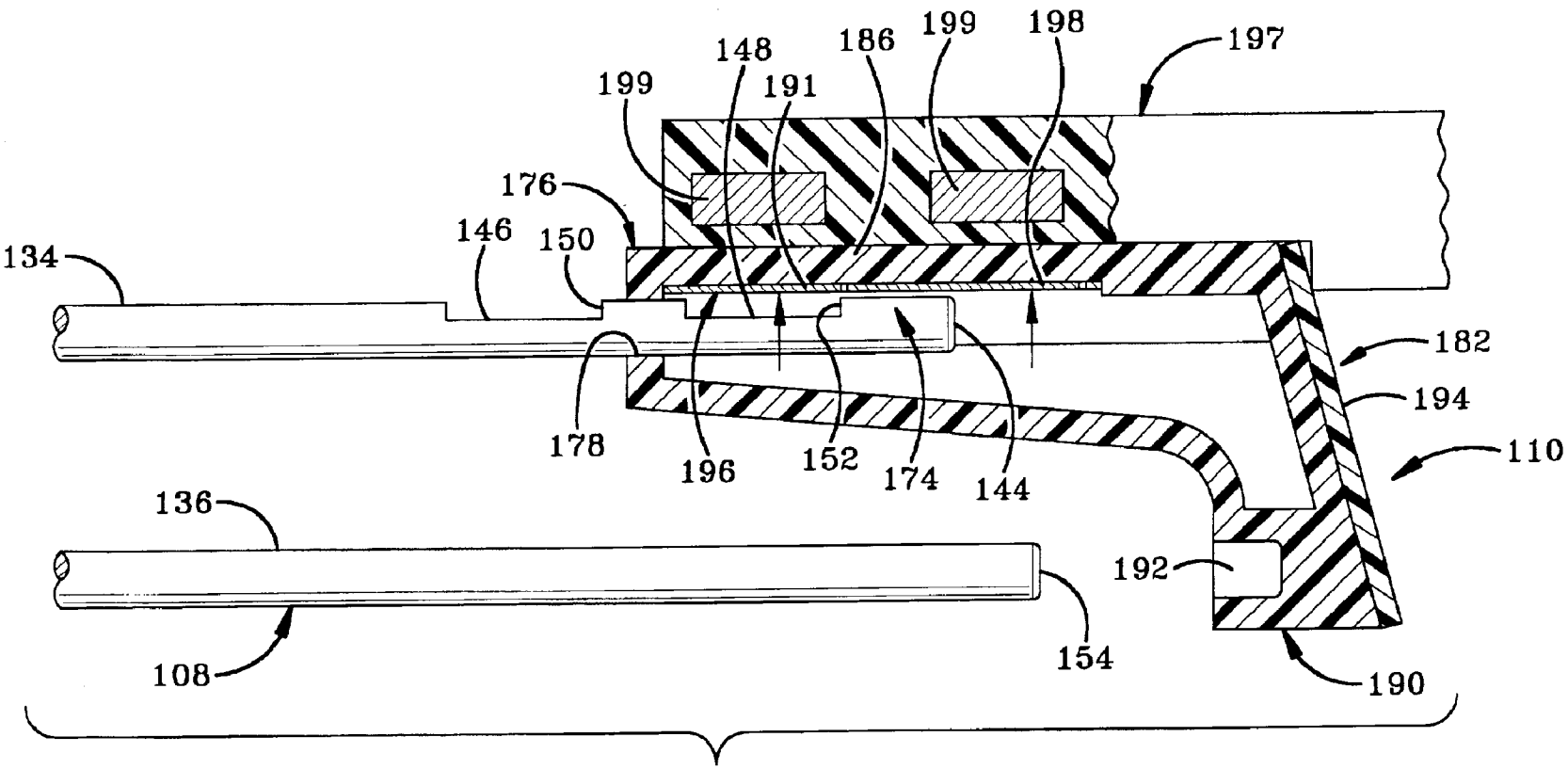
FIG. 15 is similar to FIG. 14, but shows the key adjacent the end assembly to disengage the locking mechanism.
Figure 18:
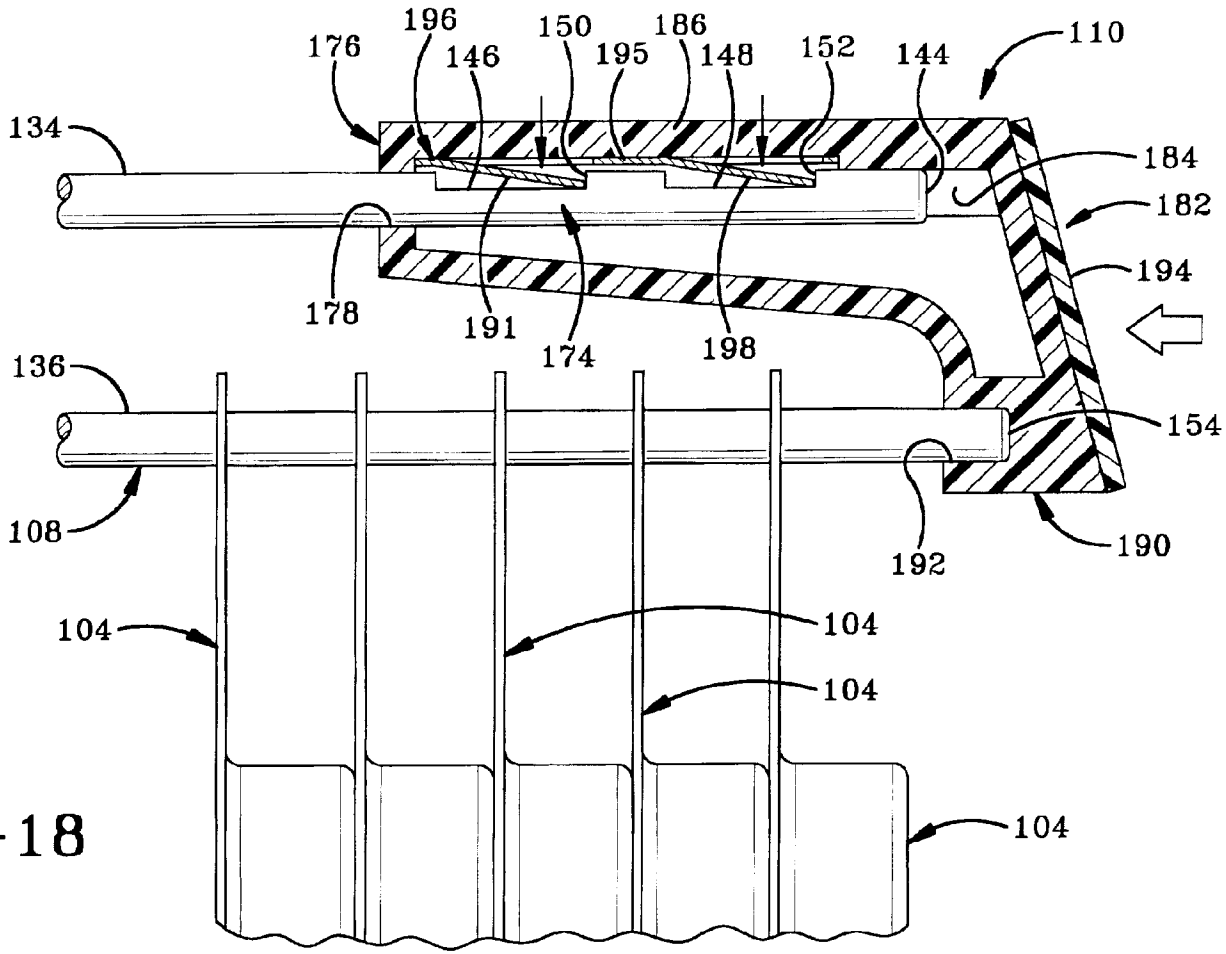
FIG. 18 is similar to FIG. 12 but showing the end assembly having been reinstalled on the rod assembly in a locked position after items of merchandise have been loaded on the rod assembly.

As noted above, end assembly 110 (FIGS. 12–18) is used in conjunction with rod assembly 108. Lower rod 136 of rod assembly 108 has a generally circular cross-section complementary to opening 192. Opening 192 is slightly larger than finger 158 to allow insertion of finger 158 into opening 192. End assembly 110 may be completely removed from rod assembly 108. FIG. 12 shows end assembly in the locked position. In the locked position, end assembly 110 may not rotate about upper rod 134 due to lower rod 136 being inserted into opening 192 so that end assembly 110 engages lower rod 136. Like the potential rotation of base assembly 106 about upper rod 134, end assembly 110 may rotate about upper rod 134 due the the circular cross section of upper rod 134. Thus, upper rod 134 may have a non-circular cross-section which in conjunction with a complementary hole 178 in end assembly 110 would also prevent the rotation of end assembly 110 about upper rod 134. FIG. 13 shows end assembly 110 being unlocked by magnetic key 197. FIG. 14 shows end assembly 110 moved outwardly into an intermediate position which is allowed by the pair of fingers 191 and 198 of spring element 196 in conjunction with the pair of notches 146 and 148. Specifically, locking mechanism 174 is unlocked by placing key 197 over the inner and outer fingers 191 and 198 so that the fingers are pulled out of respective notches 146 and 148. Then, end assembly 110 is slid outwardly so that inner finger 191 is adjacent notch 148 and outer finger 198 extends beyond outer end 144 of rod assembly 108. Key 197 may then be removed so that inner finger 191 is released and moves due to its spring bias into notch 148. In this position (FIG. 14), end assembly 110 is disengaged from lower rod 136 so that items 104 of merchandise may be removed from or installed on lower rod 136, but end assembly 110 is still connected to upper rod 134 and is not removable therefrom without key 197. FIG. 15 shows end assembly 110 in a position moved further outwardly from the locked position with magnetic key 197 still adjacent end assembly 110 and holding fingers 166 upwardly. FIG. 16 shows end assembly 110 completely removed from rod assembly 108 and key 197 removed from end assembly 110. FIG. 19 shows item 104 of merchandise being loaded onto lower rod 136, the loading process being facilitated by the complete removal of end assembly 110 from rod assembly 108. FIG. 18 shows end assembly 110 having been reinstalled on rod assembly 108 and the locked position as fingers 191 and 198 move downwardly into notches 146 and 148. The locked position is achieved simply by sliding end assembly 110 inwardly on rod assembly 108 and requires no key nor additional motion as fingers 191 and 198 are spring biased to snap into the locked position. Simi Regarding end assembly 110A (FIGS. 19–22), when locking mechanism 174 is in the unlocked position and end assembly 110A is slid outwardly along rod assembly 108, projection 180 engages ledge 150 as shown in FIG. 22 to prevent end assembly 110A from being removed from upper rod 134. In conjunction with end assembly 110A, rod assembly 108A includes lower rod 136 having finger 158 which has a generally semi-circular cross-section and is complementary to opening 192A of end assembly 110A. Opening 192A is slightly larger than finger 158 to allow insertion of finger 158 into opening 192A. The non-circular cross-section of finger 158 and hole 192A tends to prevent rotation of end assembly 110A about lower rod 136. As shown in FIG. 20, end assembly 110A also has a ledge 193 configured to engage with a corresponding ledge or protuberance of key 197 (such as protuberance 117 of key 114) to facilitate pulling end assembly 110A outwardly from rod assembly 108A. Like end assembly 110, the rotation of end assembly 110A about upper rod 134 may be prevented by upper rod 134 having a non-circular cross-section in conjunction with a complementary hole 178 in end assembly 110A. In addition, the respective non-circular cross-sections of finger 158 and hole 192A play a role in preventing this rotation about upper rod 134. Where rod assembly 108 is made of materials having a degree of flexibility, some rotation about upper rod 134 could occur even in the locked position if upper rod 134 and lower rod 136 are forced to move about one another, this being especially due to increased leverage of upper rod 134 and lower rod 136 at outer end 144 of rod assembly 108. However, the non-circular cross-sections of finger 158 and hole 192A eliminate or reduce the rotation of end assembly 110A about lower rod 136 and consequently about upper rod 136 as well.

It will appreciated that many variations exist of the merchandise display hook without departing from the spirit of the invention. For example, the locking mechanism found in base assembly 106 may have a variety of configurations and need not be opened by a magnetic key. Most importantly, base assembly 106 is slidable along rod assembly 108 and is also lockable to rod assembly 108 in such a manner as to lock the merchandise display hook to a display board. Further, the rod assembly could have only one rod to which the end assembly would be lockable and removable so that the single rod could also function as the support for the items of merchandise. Like the base assembly, the end assembly may also have a variety of locking mechanisms to lock the end assembly to the rod assembly. These and other variations may be made without departing from the spirit of the invention.

Thus, merchandise display hook 100 provides a display hook which both locks to a display board via a lockable base assembly 106 and also includes an end assembly 110 which locks to rod assembly 108 to prevent removal of items 104 of merchandise when in a locked position. Merchandise display hook 100 thus prevents a potential shoplifter from removing items 104 of merchandise from display hook 100 or removing display hook 100 from a display board 102.

A second embodiment of the present invention is indicated generally at numeral 200 and is shown in FIGS. 23–28. Display hook 200 is used with a wire rack display board 202 having a mesh of horizontal wires 203 and vertical wires 205 to support items of merchandise in a similar manner as shown with the first embodiment. Display hook 200 holds multiple items of merchandise so as to prevent their rapid removal therefrom. Display hook 200 includes a base assembly 206, a rod assembly 208, and a hook 210.

Figure 24:
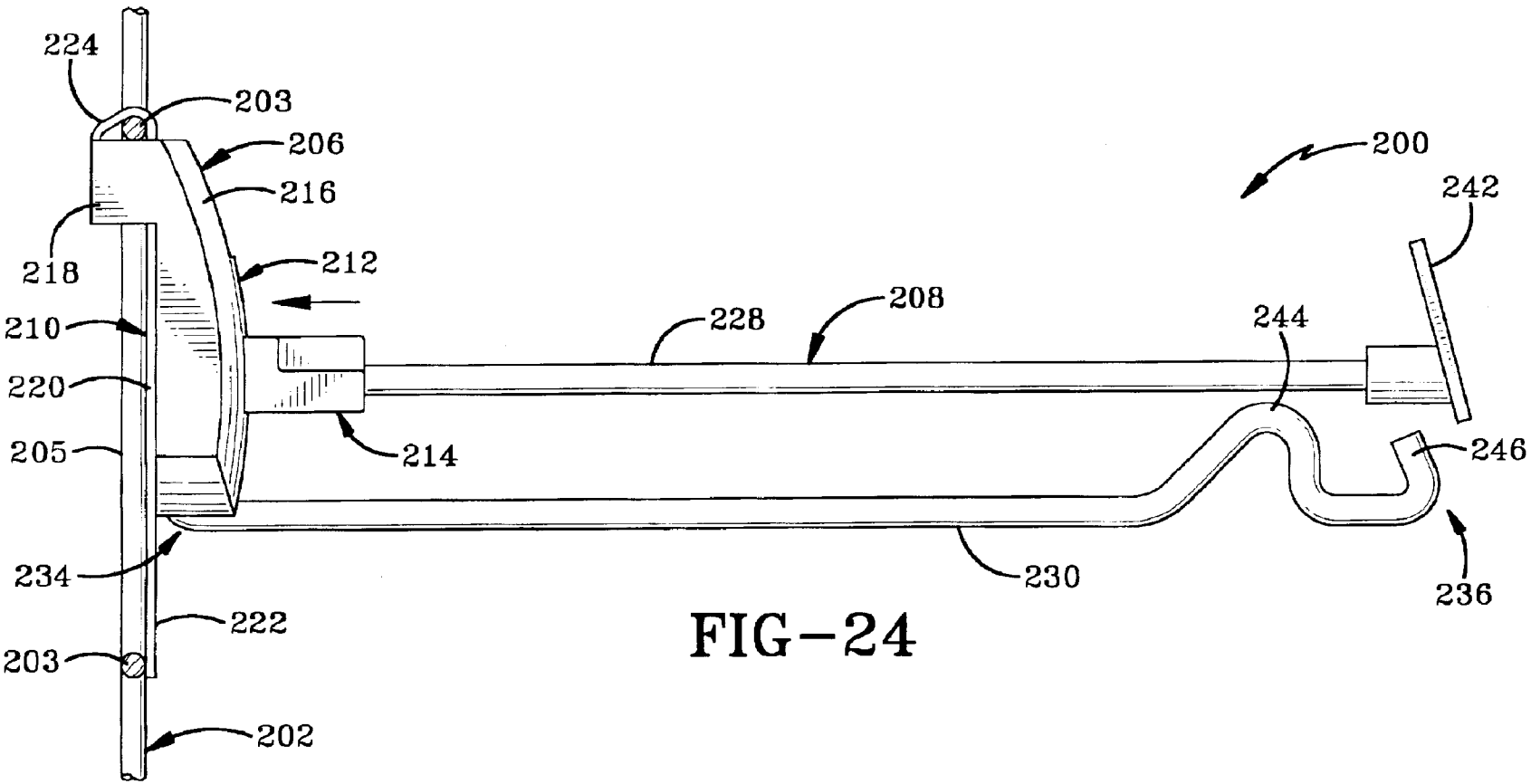
FIG. 24 is similar to FIG. 23 but shows the second embodiment of the display hook connected and locked to the wire rack.
Figure 25:
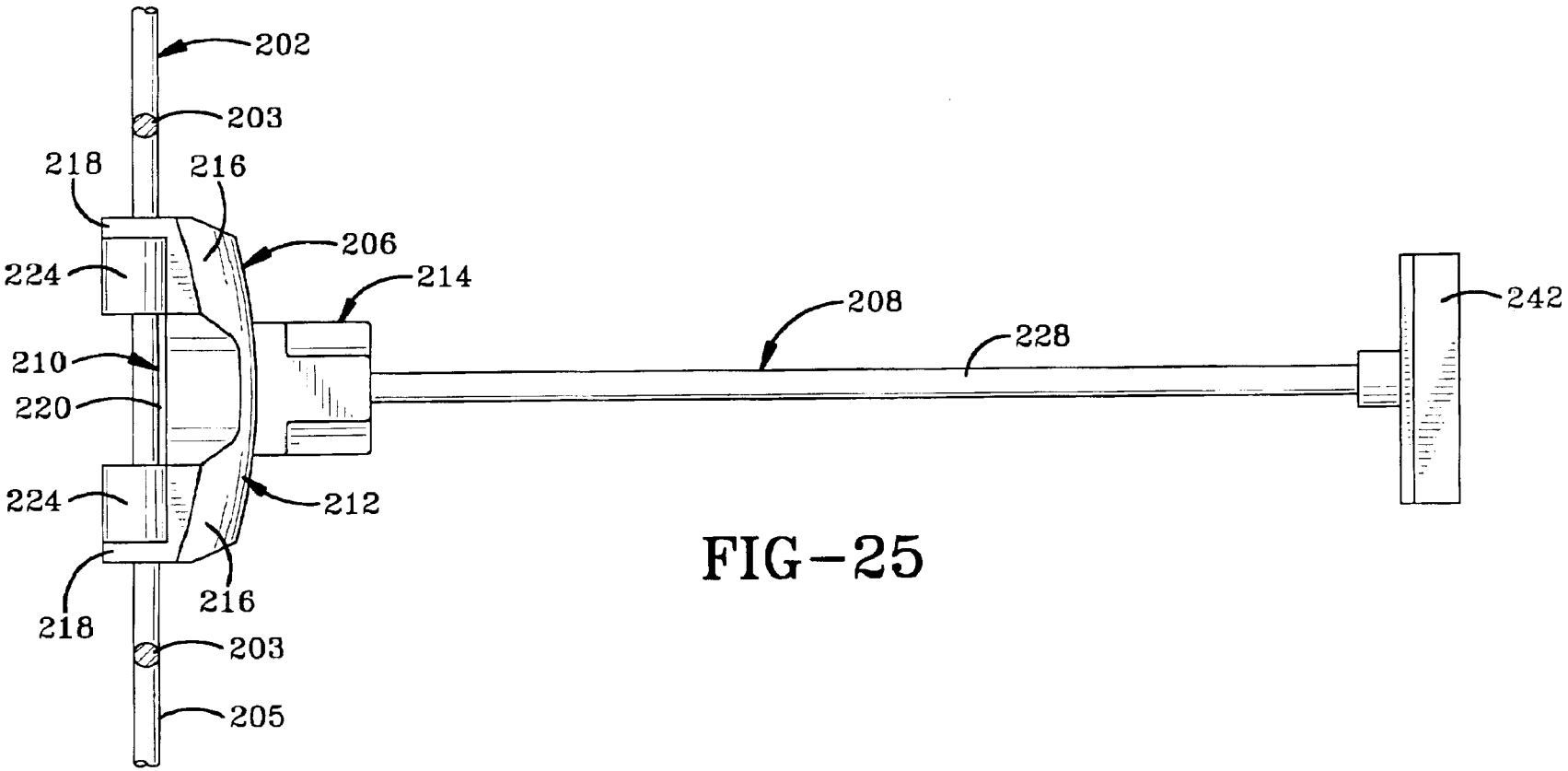
FIG. 25 is a plan view of the display hook as shown in FIG. 24.

Lockable base assembly 206 is similar to base assembly 106 with the exceptions described below and includes a locking mechanism which is the same as that of base assembly 106. Base assembly 206 selectively secures display hook 200 to wire rack display board 202 in a manner that prevents display hook 200 from being removed from display board 202 without use of a specific key like key 114 used with merchandise display hook 100. Base assembly 206 includes a foot 212 and a leg 214 extending outwardly therefrom. As shown in FIG. 24, foot 212 includes a pair of upwardly extending spaced arms 216. As shown in FIGS. 21 and 25, a pair of spaced tabs 218 extend outwardly from foot 212 in a direction opposite the extension of leg 214.

Hook 210 includes a pair of upwardly extending spaced fingers 220 and a downwardly extending tongue 222, as seen in FIG. 24. Hook 210 further includes a pair of spaced claws 224 having respective sides 225 and extending outwardly and then downwardly from respective fingers 220. Hook 210 is connected to rod assembly 208 by a weld 226 or by other means known in the art.

Rod assembly 208 includes an upper rod 228, a lower rod 230 and a connecting rod 232 formed integrally with and connecting upper rod 228 and lower rod 230. Rod assembly 208 has an inner end 234 and an outer end 236. Adjacent inner end 234, upper rod 228 defines a sloping notch 238 bounded by a ledge 240. A display face 242 is connected to upper rod 228 at the outer end 236 of rod assembly 208. Adjacent outer end 236, lower rod 230 includes an upwardly extending portion 244. Lower rod 230 terminates in an upwardly extending tip 246 which also angles inwardly toward inner end 243 of rod assembly 208.

Figure 23:
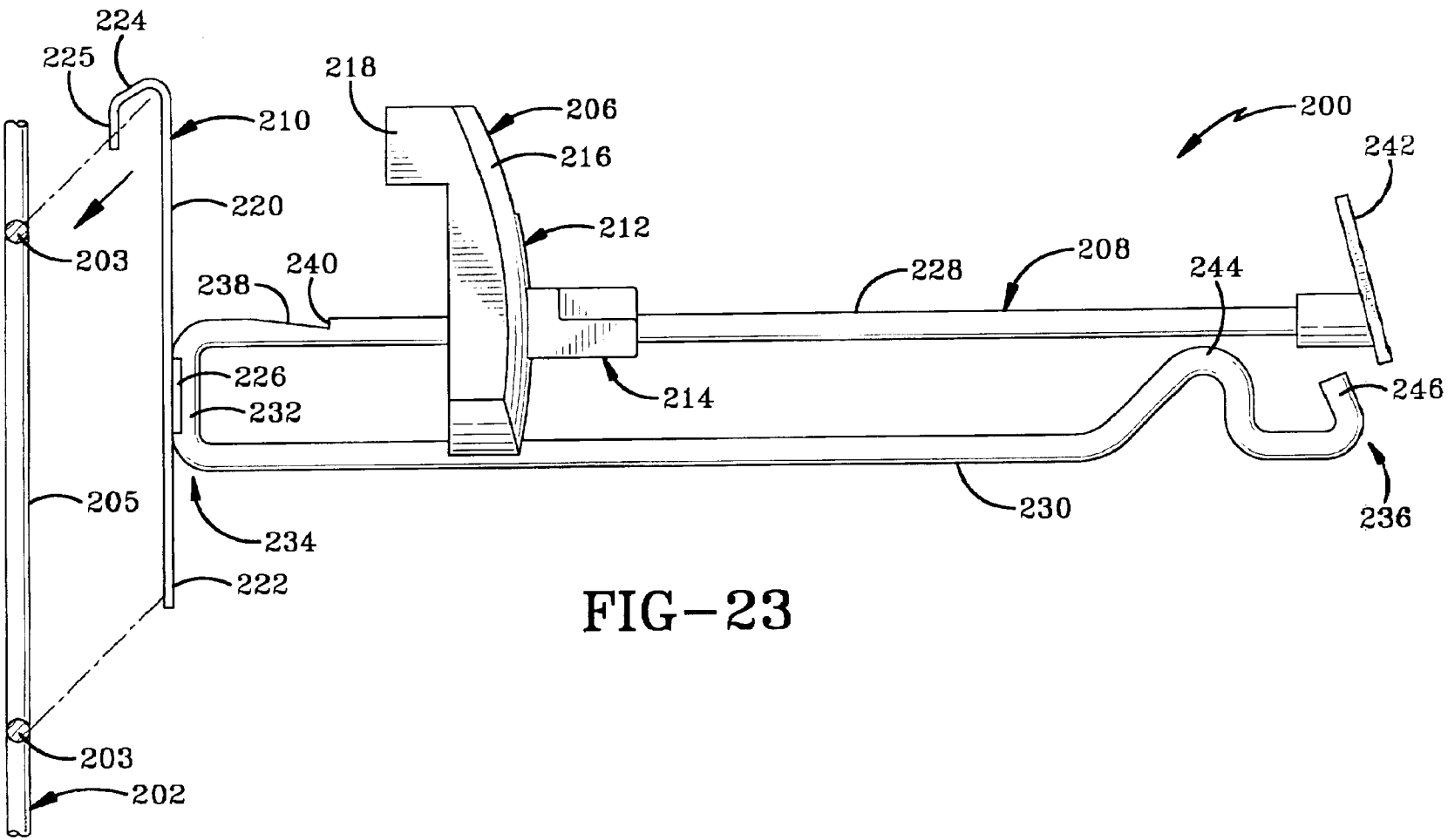
FIG. 23 is a side elevational view of a second embodiment of the present invention prior to hanging the display hook on a wire rack.
Figure 26:
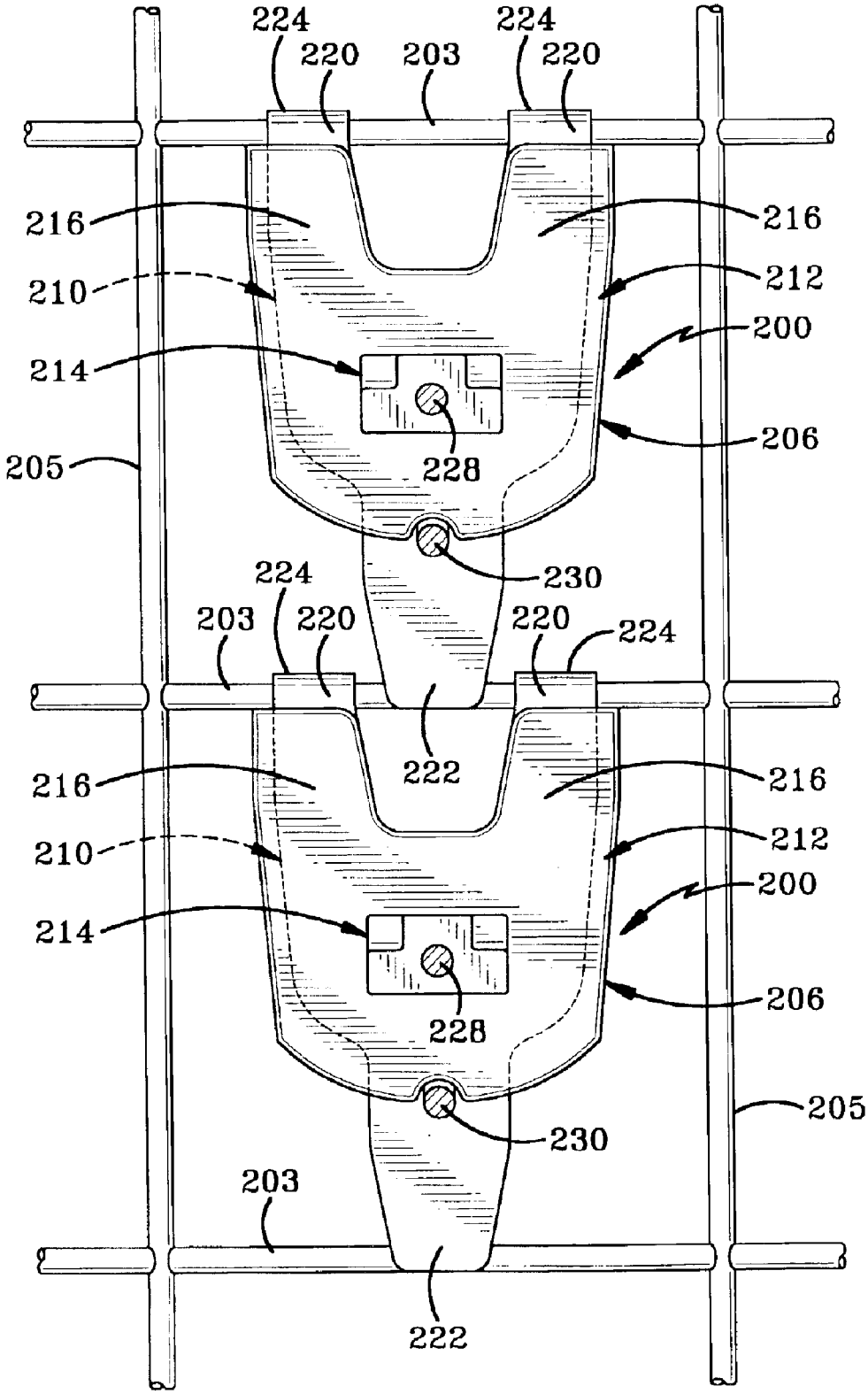
FIG. 26 is a front elevational view with the rod assembly shown in section of two display hooks of the second embodiment as connected to the wire rack one above the other.

In operation, merchandise display hook 200 functions as follows. In accordance with the present invention, base assembly 206 is slidable along rod assembly 208 in the unlocked position and lockably engages with ledge 240 of slot 238 in the locked position via locking mechanism 159 as used with display hook 100. To install display hook 200 on wire rack display board 202, base assembly 206 is unlocked and slid outwardly along rod assembly 208 away from hook 210, as shown in FIG. 23. In this position, sides 225 of claws 224 of hook 210 are open so that claws 224 may hook over a horizontal wire 203 of wire rack display board 202. Once installed, tongue 222 of hook 210 abuts a lower horizontal wire 203, thus preventing display hook 200 from pivoting downwardly about the upper wire 203 over which claws 224 are hooked. This keeps rod assembly 208 in a substantially horizontal position, as seen in FIG. 22. Once display hook 200 is installed on wire rack 202, base assembly 206 is slid along rod assembly 208 toward hook 210 into the locked position, as shown in FIG. 24. In the locked position, tabs 218 of base assembly 206 are situated just outside claws 224 closely adjacent respective sides 225, as shown in FIGS. 25 and 26. Thus, claws 224 pass over horizontal wire 203 while tabs 218 pass under the same horizontal wire 203 to prevent removal of display hook 200 from wire rack 202. In the locked position, base assembly 206 cannot rotate about upper rod 228, which rotation would cause locking mechanism 159 to unlock as described above in relation to display hook 100. To prevent the rotation of base assembly 206 about upper rod 228 in the locked position, base assembly 206 engages connecting rod 232 about a passage like passage 130 of base assembly 106. Also preventing this rotation is the engagement of between tabs 218 of base assembly 206 and sides 224 of claws 224. As with display hook 100, the rotation of base assembly 206 about upper rod 228 may be prevented by upper rod 228 having a non-circular cross-section in conjunction with a complementary hole in base assembly 206, like hole 124 in base assembly 106.

Figure 27:
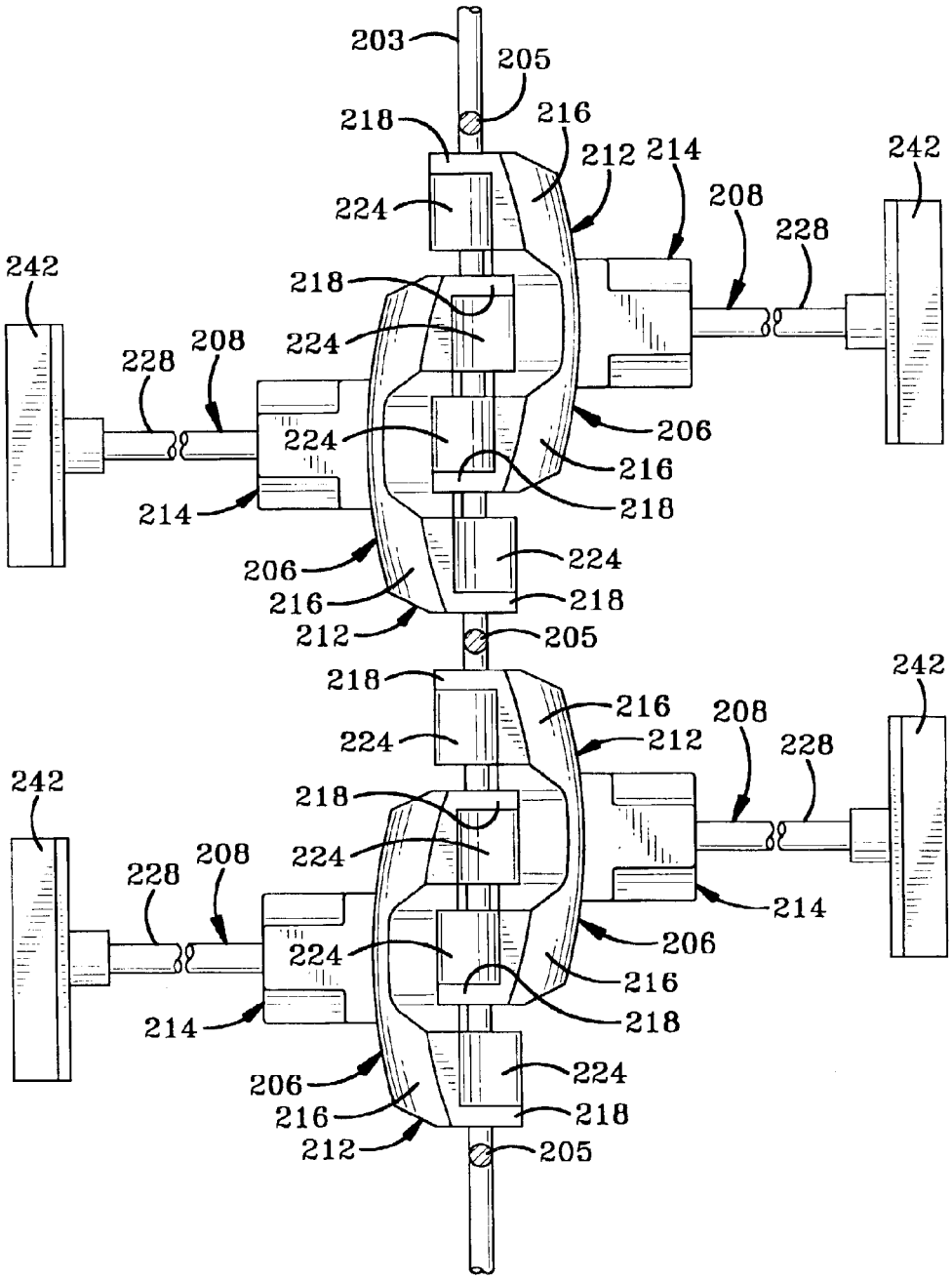
FIG. 27 is a plan view of four of the display hooks of the second embodiment as connected to a wire rack and extending outwardly from both sides of the wire rack.

In accordance with the present invention, the spaced configuration of fingers 220 and claws 224 of hook 210 allows a plurality of display hooks 200 to overlap one over the other as shown in FIGS. 24 and 27 so that adjacent display hooks 200 are relatively close to one another. When used in multiples as described, one display hook 200 has a portion of tongue 222 disposed between the claws 224 of an adjacent display hook 200 so that said tongue 222 abuts the same horizontal wire 203 as is engaged by claws 224 of the adjacent display hook 200.

As shown in FIG. 24, multiple display hooks 200 may thus extend closely adjacent one another from the same side of wire rack 202 to permit greater utilization of space in displaying items of merchandise. FIGS. 23 and 24 show display hook 200 in use with a wider-mesh wire rack 202, in particular having parallel wires spaced approximately two inches apart. FIGS. 26 and 27 show an alternative wire rack 202 wherein the mesh is finer, particularly having parallel wires spaced approximately one inch apart. This illustrates that display hook 200 may be used with wire racks having meshes of varying sizes.

In accordance with the present invention, the spaced nature of claws 224 also allows display hook 200 to extend from opposite sides of wire rack 202 in an overlapping of fashion with another display hook 200, as shown in FIG. 27. In this configuration, one claw of each display hook 200 is disposed between the spaced pair of claws 224 of another display hook 200 while the respective rod assemblies 208 of the overlapped display hooks 200 extend outwardly in opposite directions from opposite sides of wire rack 202. This usage is allowed in part by the fact that, except for claws 224 and tabs 218, no portion of display hook 200 extends beyond the side of wire rack 202 on which a given display hook 200 is mounted. Thus, each display hook 200 connected to wire rack 202 in a back-to-back fashion does not interfere with the other. Again, this allows for a compact usage of display hook 200.

It will be appreciated that a variety of configurations can achieve similar results without departing from the spirit of the present invention. For instance, a tongue like tongue 222 may extend upwardly and have a claw formed thereon from which display hook 200 would hang while fingers like fingers 220 may extend downwardly to engage wire rack 202 to prevent the downward pivoting movement. In short, the tongue and fingers may switch positions. By way of further example, instead of having a tongue 222 extending downwardly, hook 210 may have members extending outwardly to engage vertical wires 205 of wire rack 202. In an alternative configuration, claws like claws 224 may be adapted to lockably engage vertical wires 205 while resting on horizontal wires 203. Nonetheless, in the preferred embodiments, the configuration of claws 224 and tongue 222 maintains a compact unit while allowing the functions as described.

Figure 37:
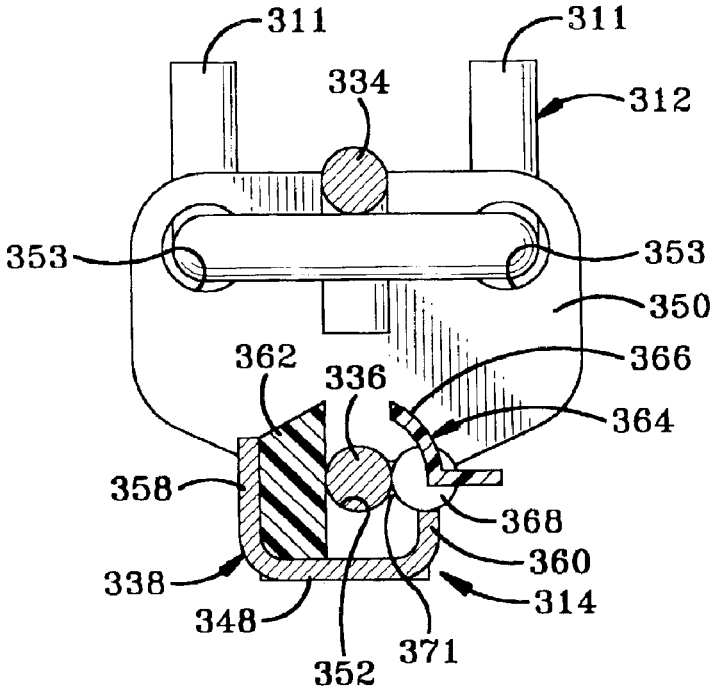
FIG. 37 is a sectional view taken on line 37—37 of FIG. 35.
Figure 38:
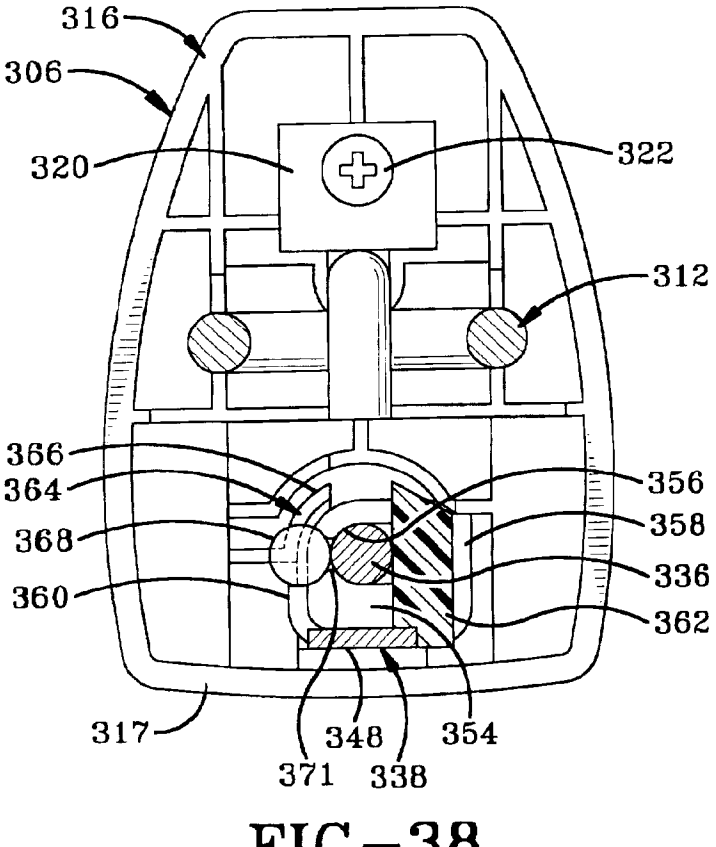
FIG. 38 is a sectional view taken on line 38—38 of FIG. 35.
Figure 39:
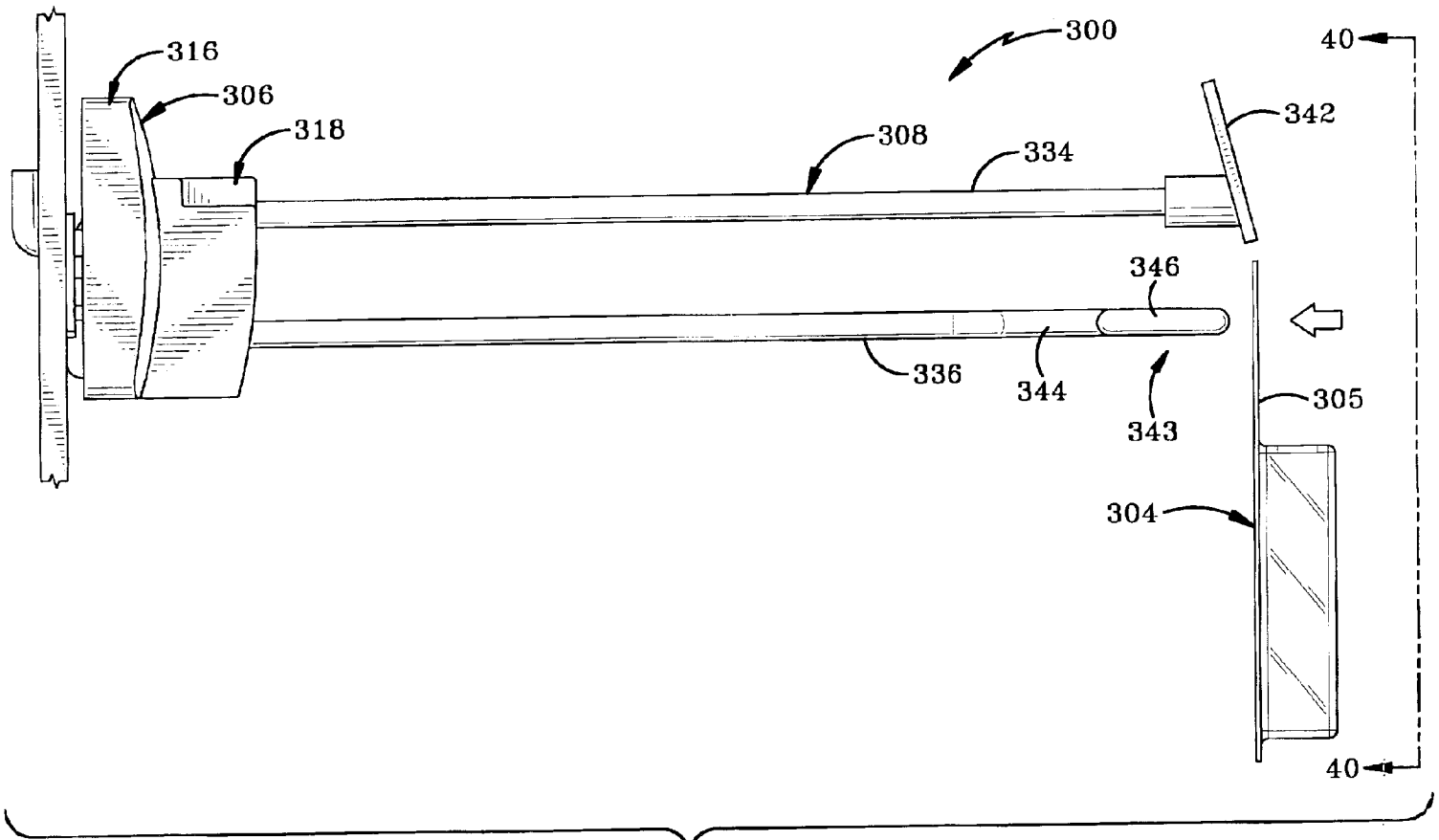
FIG. 39 is a side elevational view similar to FIG. 32 with the rod assembly in a loading position in an item of merchandise being installed on the lower rod.
Figure 42:
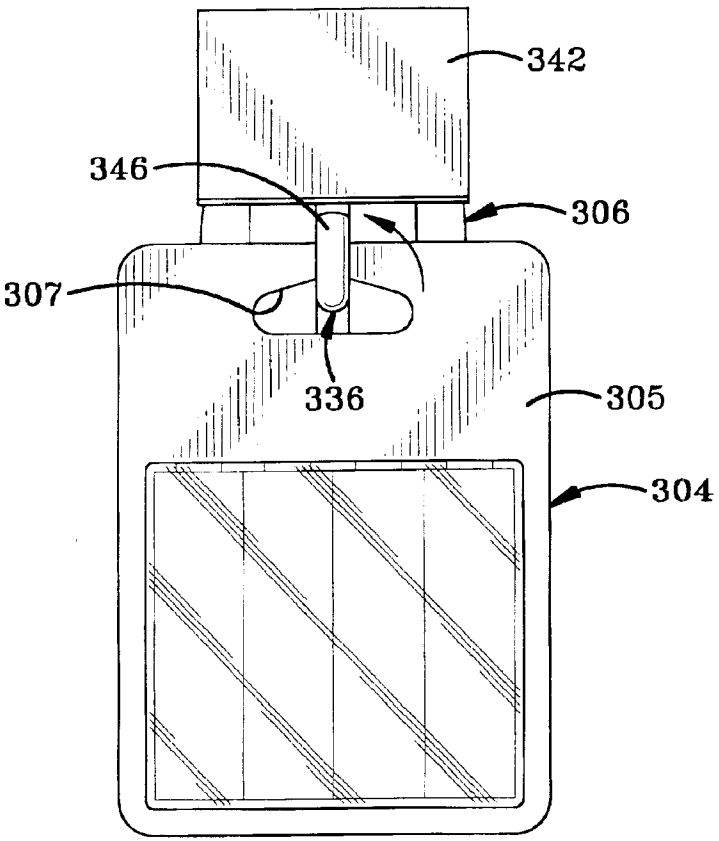
FIG. 42 is a front elevational view taken on line 42—42 of FIG. 41.
Figure 40:
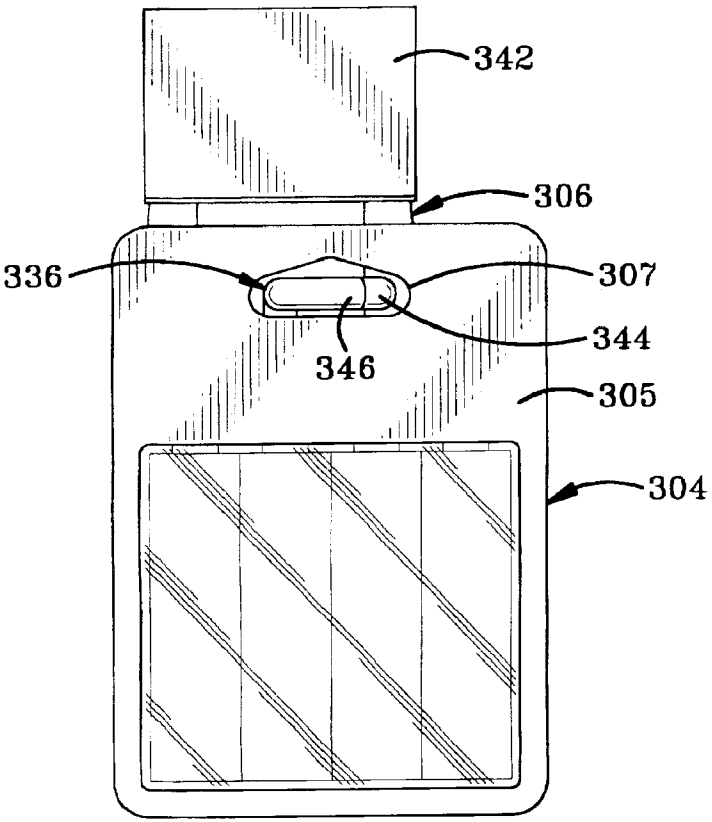
FIG. 40 is a front elevational view taken on line 40—40 of FIG. 39.
Figure 41:
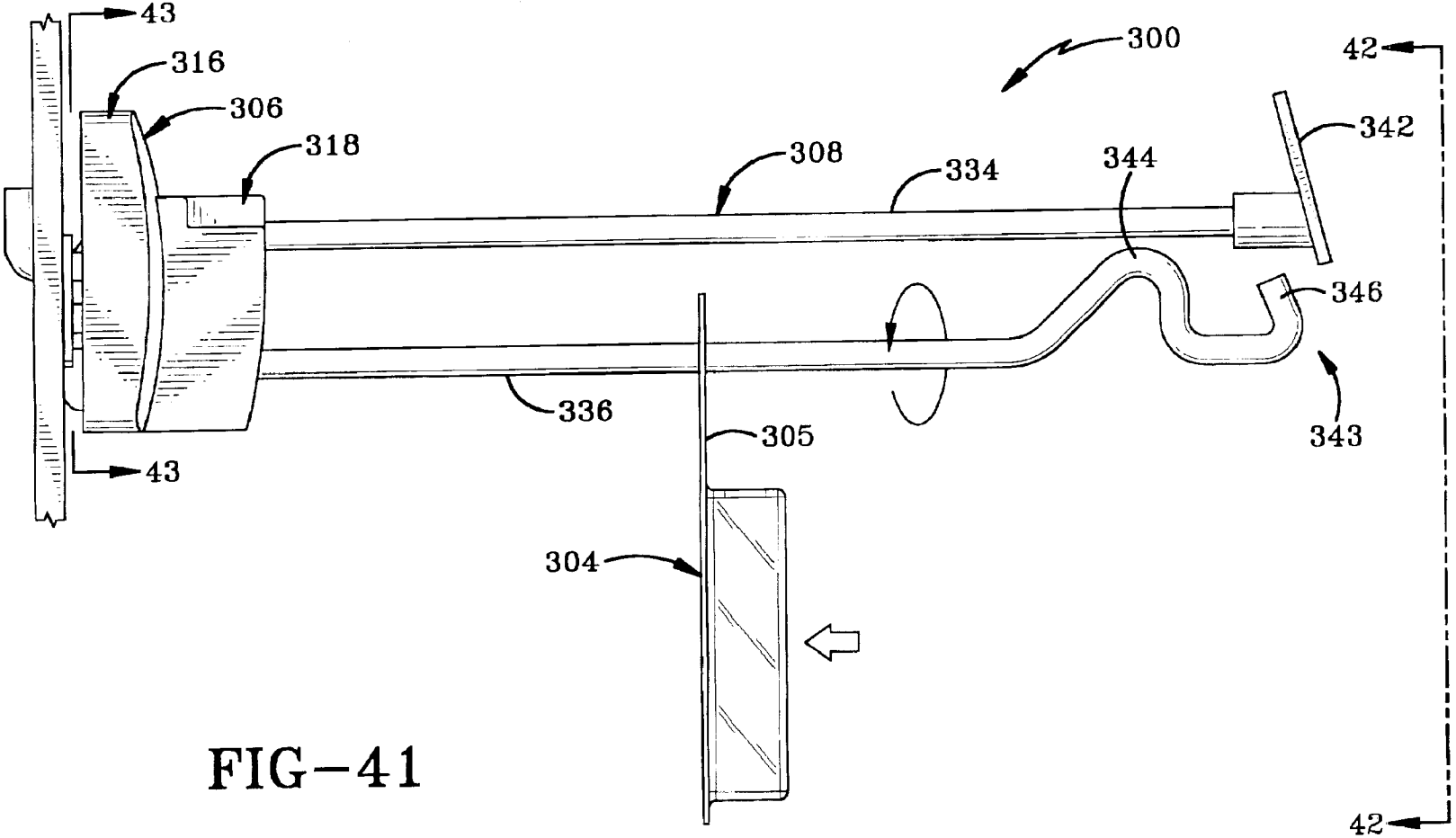
FIG. 41 is a side elevational view similar to FIG. 39 but showing an item of merchandise being installed and the lower rod being rotated into an anti-sweeping position.
Figure 44:
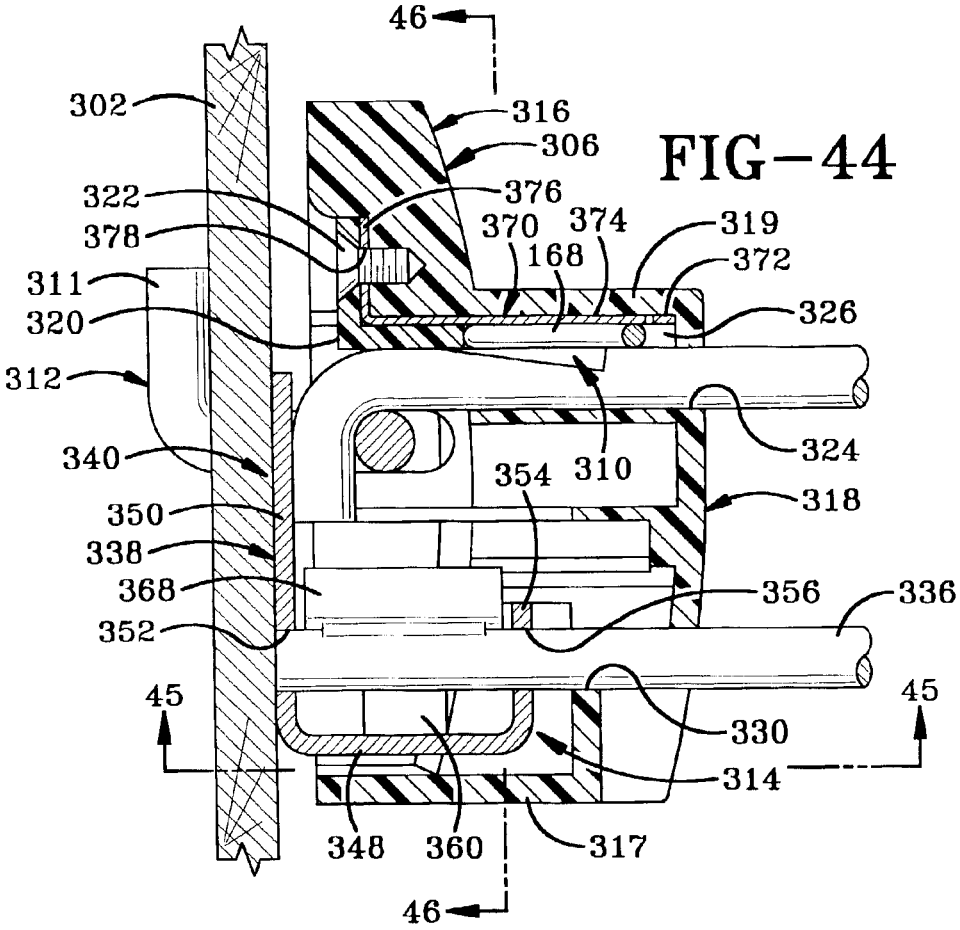
FIG. 44 is a sectional view taken on line 44—44 of FIG. 43.

A third embodiment of the present invention is indicated generally at 300 and is shown in FIGS. 28–47. Display hook 300 is used with a display board 302 (peg board or slat board) having holes 303 to support items 304 of merchandise for display in the retail environment. Items 304 of merchandise are encased in a package 305 which defines a slot 307. Slot 307 is horizontally elongated (FIGS. 38, 40). Display hook 300 holds multiple items 304 of merchandise to prevent their rapid removal when display hook 300 is in a locked position (FIGS. 45–46) and to allow easy removal and loading of items 104 in an unlocked position (FIGS. 37–38). Display hook 300 includes a base assembly 306, rod assembly 308, locking mechanism 310, hook 312 and lower rod lock 314. Hook 312 includes upwardly extending ends 311.

Lockable base assembly 306 selectively secures display hook 300 to display board 302 in a manner that prevents display hook 300 from being removed from display board 302 without the use of a specific key, like key 114 used in the first embodiment. Base assembly 306 includes a foot 316 and a leg 318 extending outwardly therefrom. Leg 318 is similar to leg 118 except that it extends further downwardly below lower rod 314. Leg 318 includes an upper wall 319 and a lower wall 317. Base assembly 316 further includes a chair member 320 which is connected to foot 316 by a screw 322.

Leg 318 defines an upper hole 324 and an interior chamber 326 disposed above and communicating with hole 324. Interior chamber 326 is bounded on the one end by a portion of chair member 320. Base assembly further defines a lower hole 330 adjacent lower wall 317 of leg 318.

Rod assembly 308 includes an upper rod 334 and in accordance with the present invention, a rotatable lower rod 336 joined by a housing 338 adjacent an inner end 340 of rod assembly 308. The outer portions of rod assembly 308 are essentially the same as rod assembly 208. Thus, upper rod 334 has a display face 342 connected to upper rod 334 at an outer end 343 of rod assembly 308. When in the anti-sweeping position, the outer portion of rotatable lower rod 336 is essentially the same as rod 230. Thus, lower rod 336 includes a portion 344 that extends upwardly toward upper rod 334 and also terminates in a tip 346 extending upwardly toward upper rod 334 and inwardly toward inner end 340 (FIG. 39).

Housing 338 (FIGS. 33–35) includes a base 348 from which extends upwardly an inner wall 350 adjacent inner end 340 of rod assembly 308, said inner wall 350 defining a lower hole 352 and a pair of spaced upper holes 353. Housing 338 further includes an upwardly extending outer wall 354 defining a hole 356. Lower rod 336 extends through holes 352 and 356 of housing 338. Housing 338 further includes a high sidewall 358 and a low sidewall 360 both extending upwardly from base 348.

In accordance with the exemplary embodiment of the present invention, lower rod lock 314 includes housing 338 and the following elements. A stationary stop 362 is disposed within housing 338 adjacent high wall 358 and base 348. Moveable stop 364 includes an arcuate arm 366 which extends upwardly above low sidewall 360 and inwardly toward high sidewall 358 when base assembly 306 is in the locked position. Adjacent inner end 340 of rod assembly 308, a projection 368 in the form of a short rod extends radially outward from rotatable lower rod 336 and is connected thereto by welds 371. The short rod used as projection 368 extends parallel to lower rod 336.

Locking mechanism 310 of base assembly 306 is very similar to that of the first embodiment and may include the same strengthening elements 168, which functions in the same manner as in the first embodiment. Spring element 370 is similar to spring element 152 in that it includes a base 372 and a finger 374. However, spring element 370 also includes a tab 376 extending at right angles to base 372. Tab 376 defines a hole 378 through which screw 322 extends to connect chair member 320 and spring element 370 to foot 316 of base assembly 306. Aside from tab 376 and its connection as described, spring element 370 functions in the same manner as spring element 162.

The relationship between base assembly 306, rod assembly 308 and housing 338 is as follows. Upper rod 308 slidably and lockably extends through hole 324 of base assembly 306 and rotatable lower rod 336 likewise slidably passes through hole 330 of base assembly 306. Upper rod 334 is connected to inner wall 350 of housing 338. Hook 312 is connected to upper rod 334 and extends through holes 353 of inner wall 350 of housing 338.

Figure 28:
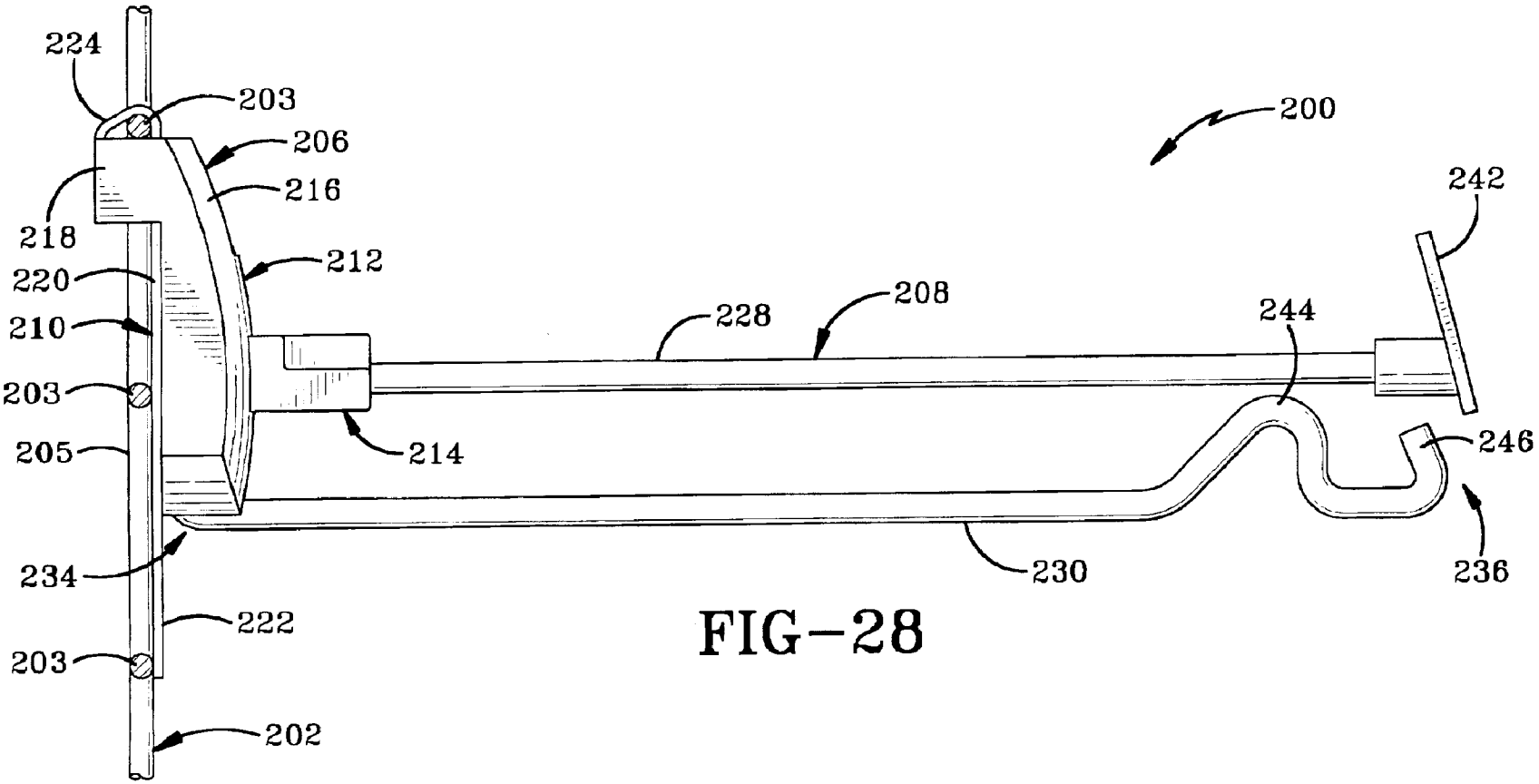
FIG. 28 is a side elevational view similar to FIG. 24 showing the second embodiment connected to a wire rack having a smaller mesh.
Figure 29:
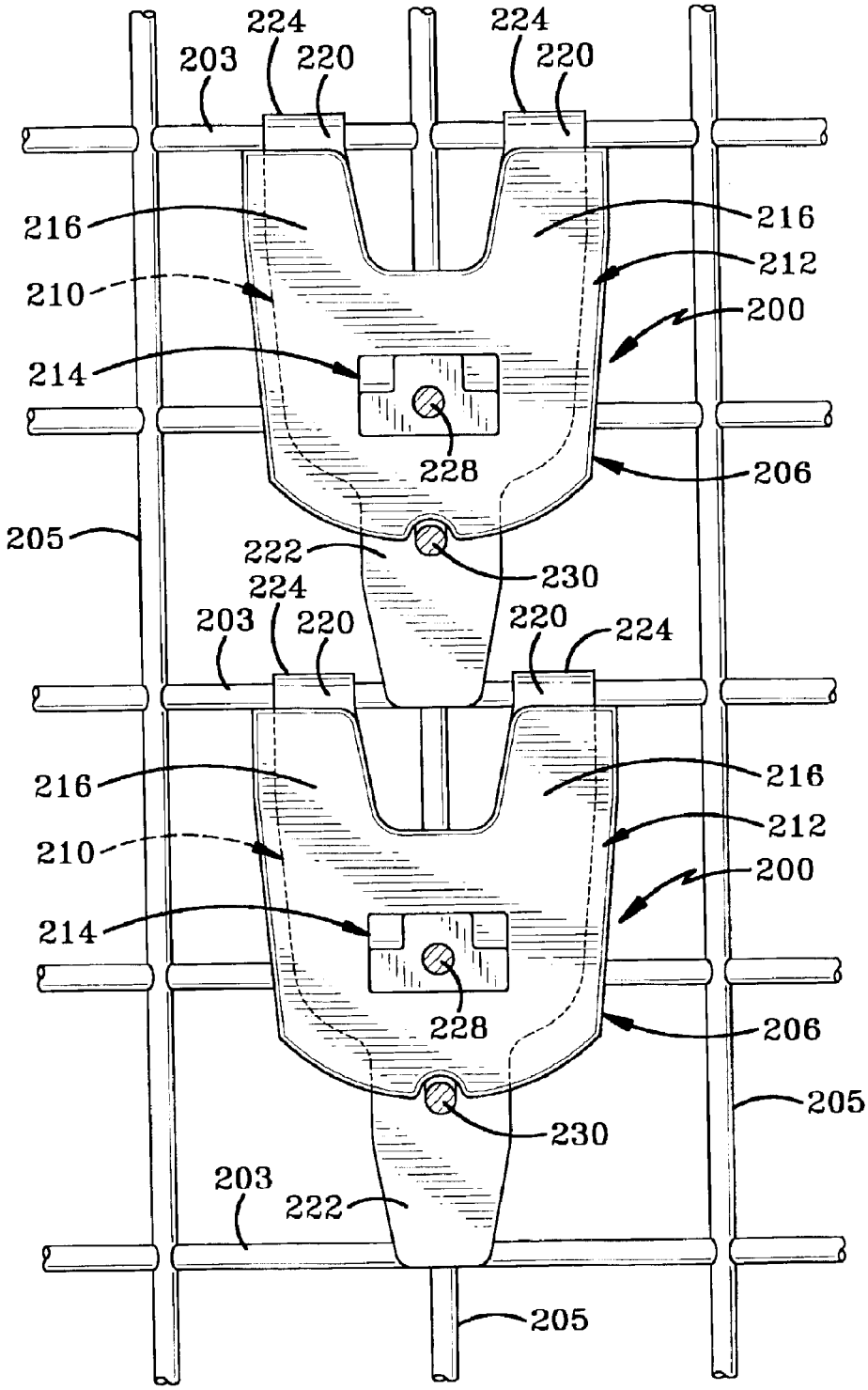
FIG. 29 is a front elevational view similar to FIG. 26 showing a pair of display hooks connected to the smaller mesh wire rack.
Figure 30:
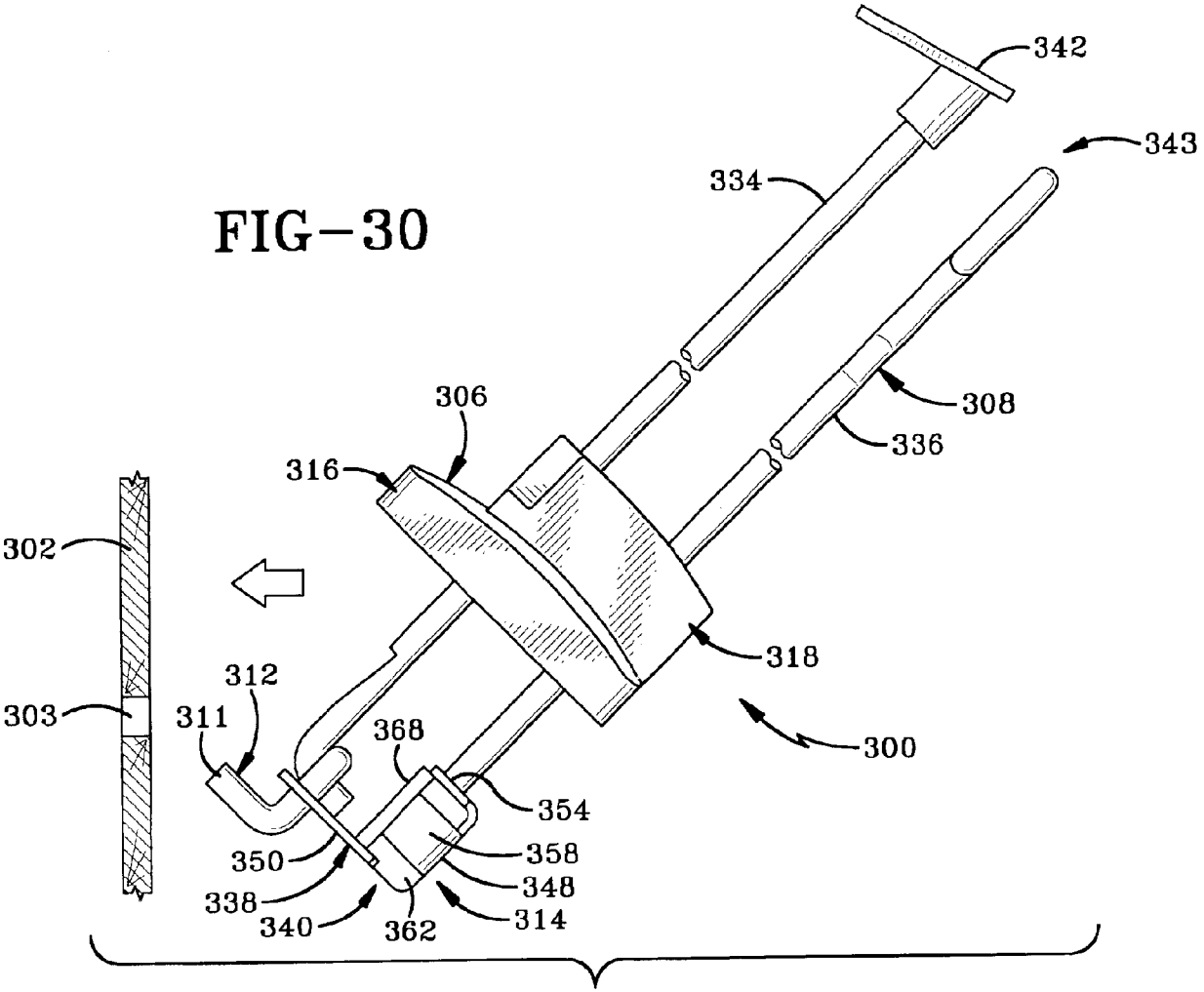
FIG. 30 is a side elevational view of a third embodiment of the present invention showing the display hook prior to connection to a display board.
Figure 31:
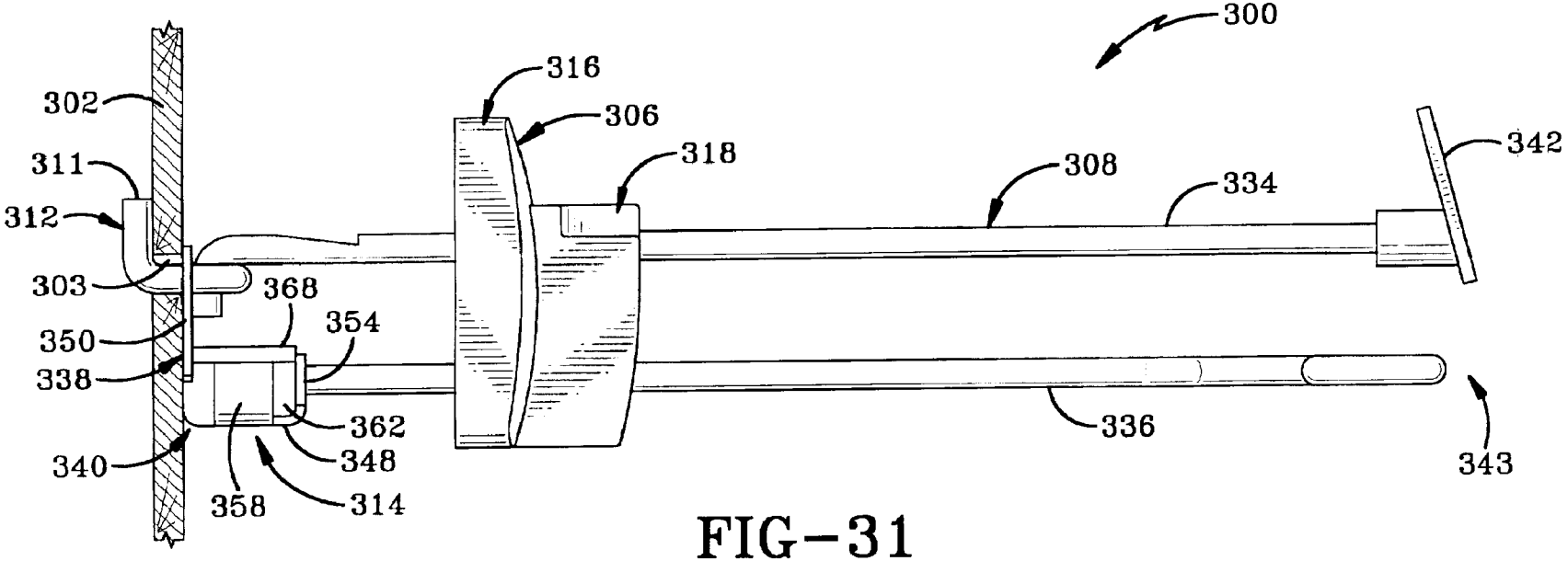
FIG. 31 is a side elevational view showing the display hook installed on the display board.
Figure 32:
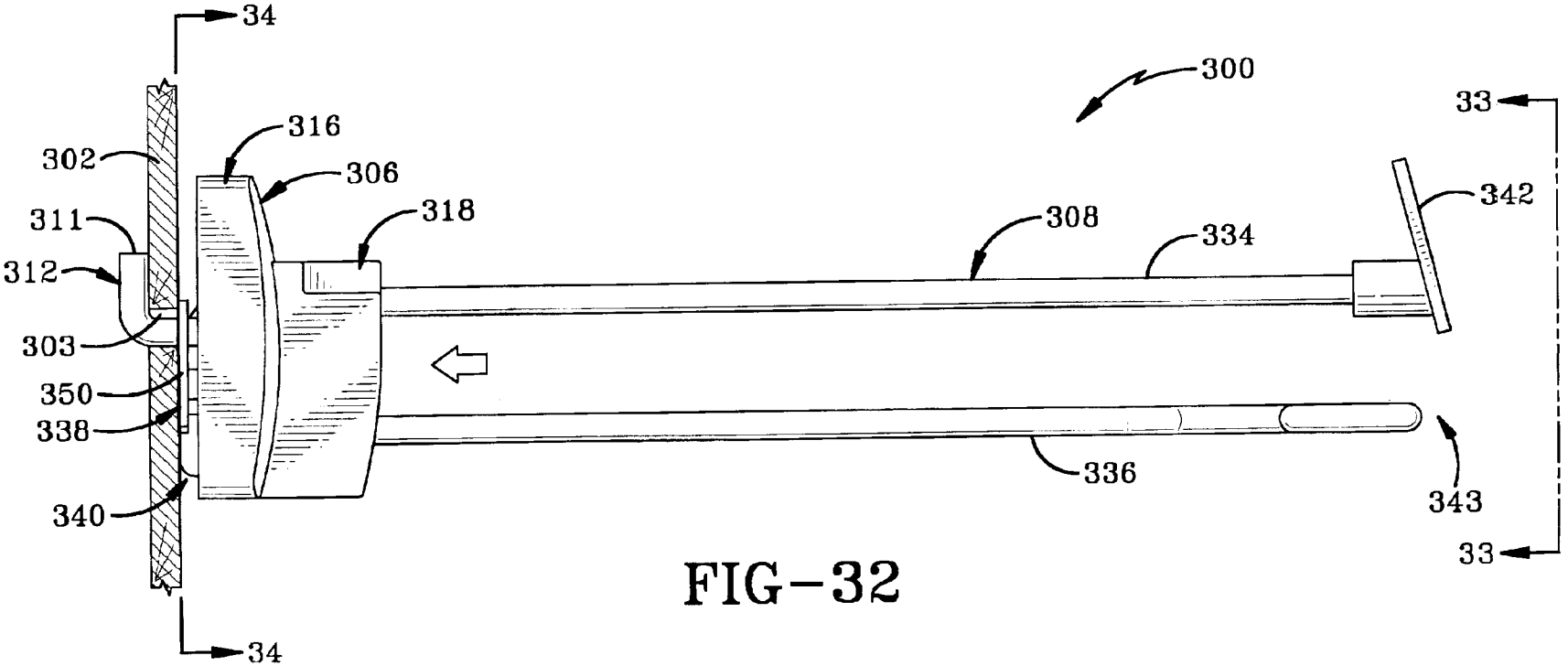
FIG. 32 is similar to FIG. 31 and shows the base assembly moving inwardly toward a locked position.
Figure 33:
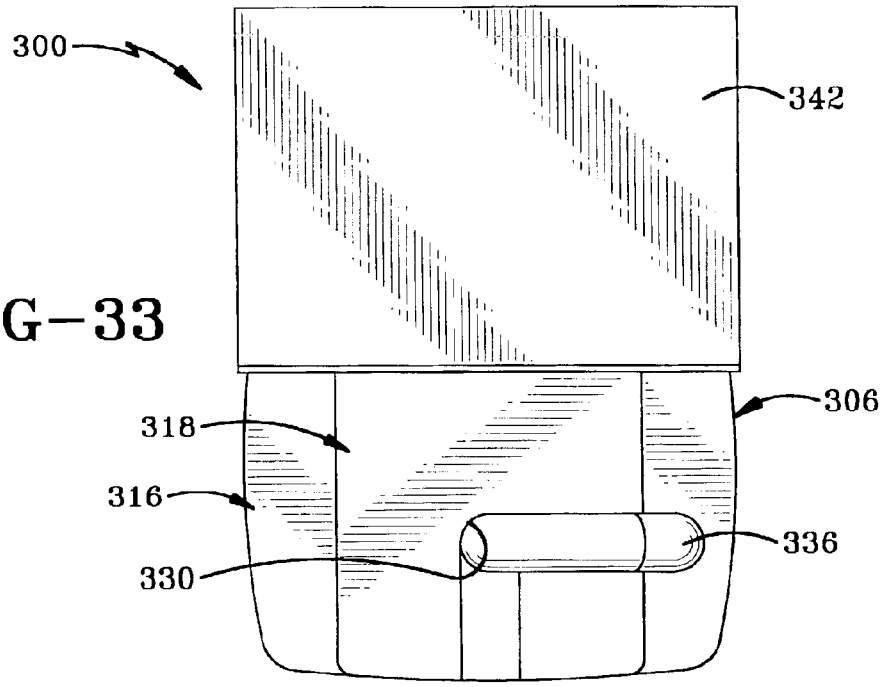
FIG. 33 is a front elevational view taken on line 33—33 of FIG. 32.
Figure 34:
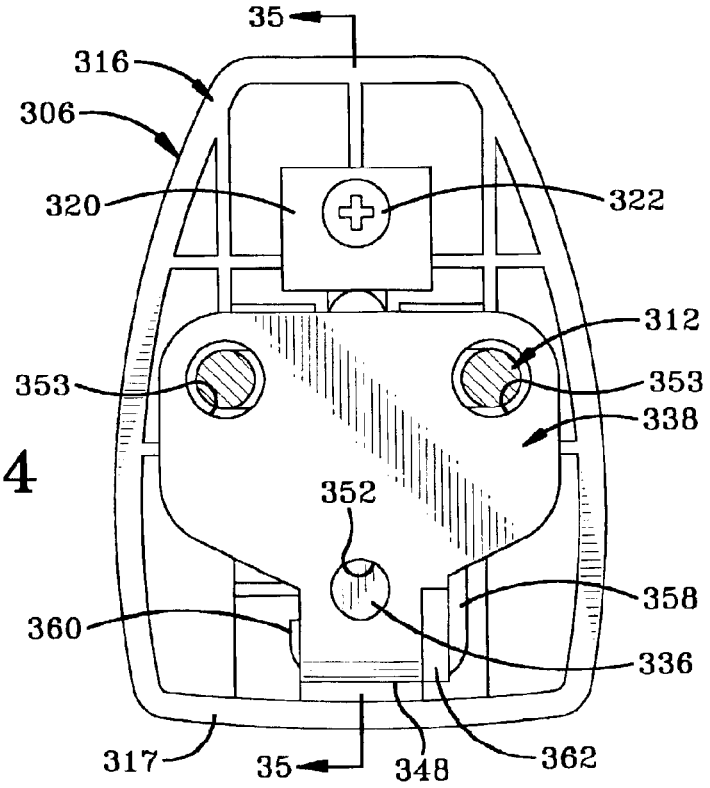
FIG. 34 is a rear elevational view with the hooks in sectional view taken along line 34—34 of FIG. 32.
Figure 35:
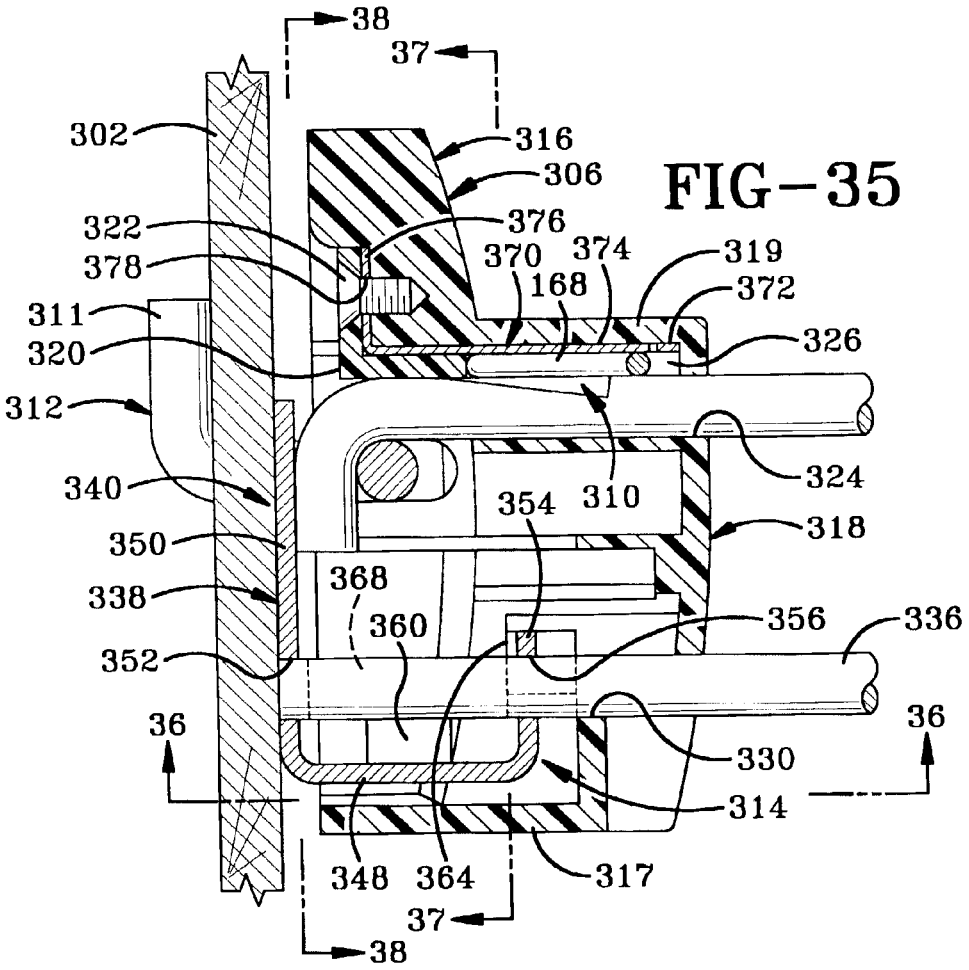
FIG. 35 is a fragmentary sectional view of the third embodiment showing the rod assembly and base assembly in an unlocked position.
Figure 36:
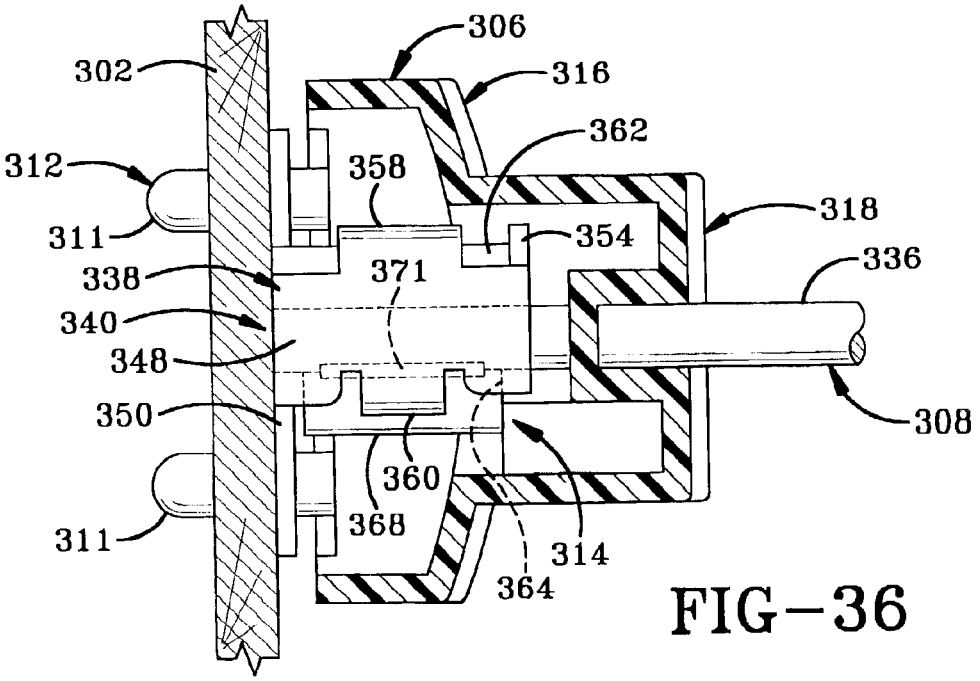
FIG. 36 is a sectional view taken on line 36—36 of FIG. 35.

In operation, merchandise display hook 300 is configured to attach to display board 302, as shown in FIGS. 28–30. To attach display hook 300 to display board 302, rod assembly 308 must be angled upwardly and outwardly with respect to display board 302 so that upwardly extending ends 311 of hook 312 may be inserted through holes 303 in display board 302 as shown in FIGS. 28–29.

Figure 46:
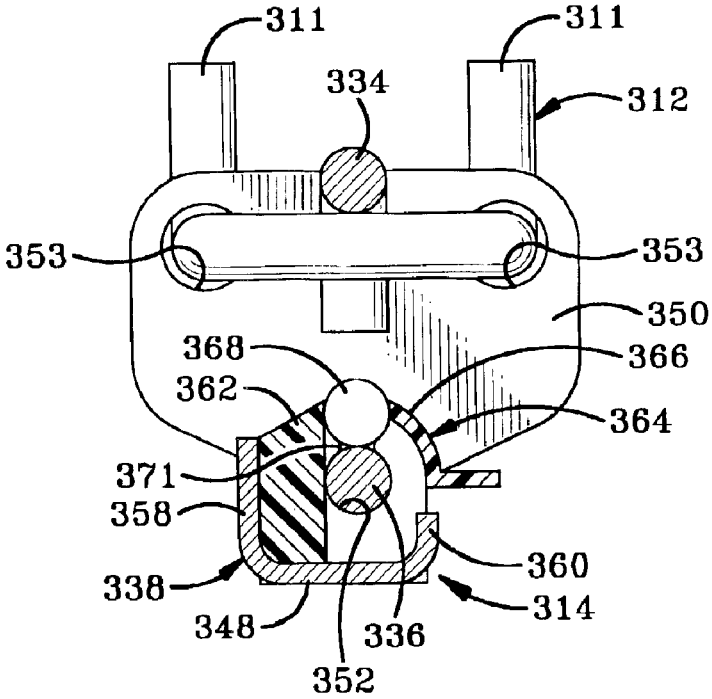
FIG. 46 is a sectional view taken on line 46—46 of FIG. 44.
Figure 43:
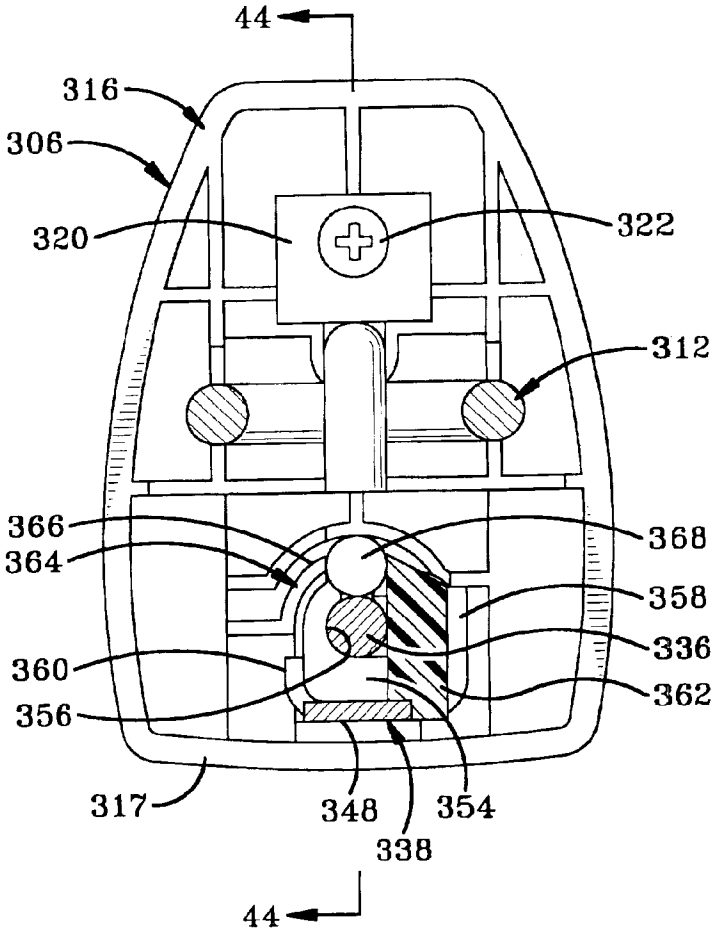
FIG. 43 is a sectional view taken on line 43—43 of FIG. 41.
Figure 45:
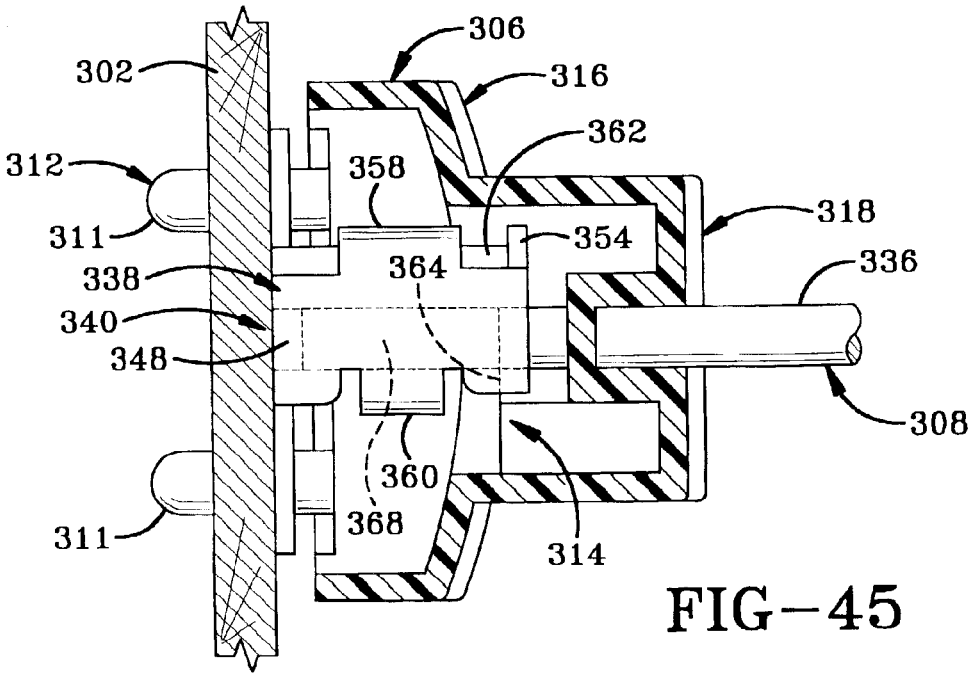
FIG. 45 is a sectional view taken on line 45—45 of FIG. 44.
Figure 47:
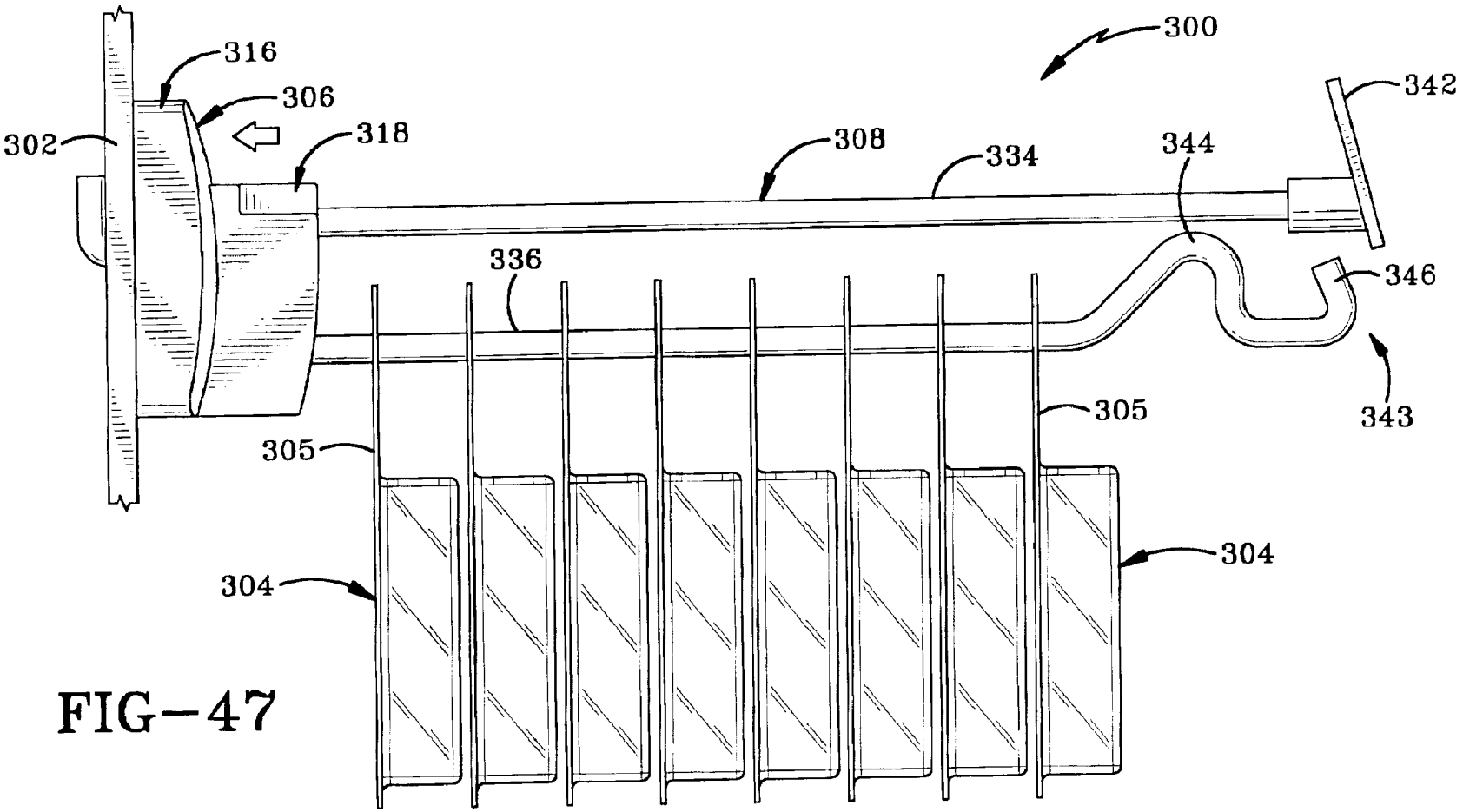
FIG. 47 is a side elevational view of the third embodiment in the locked and anti-sweeping position with items of merchandise hanging therefrom.
Figure 48:
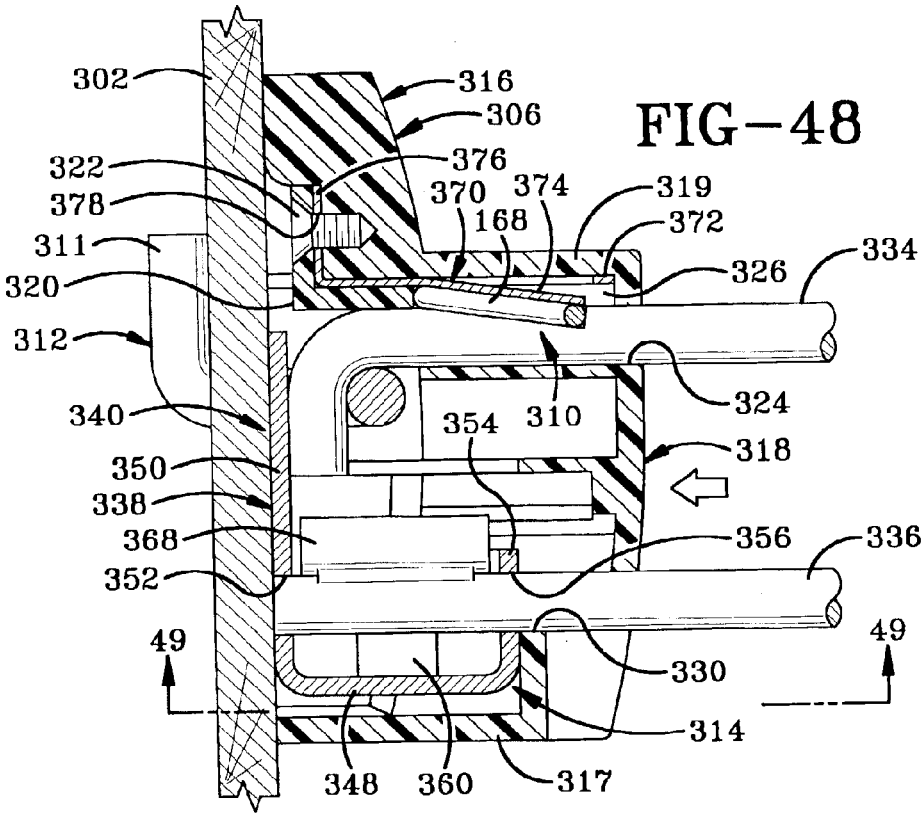
FIG. 48 is a view similar to FIG. 44 except that the locking base is in a locked position.
Figure 49:
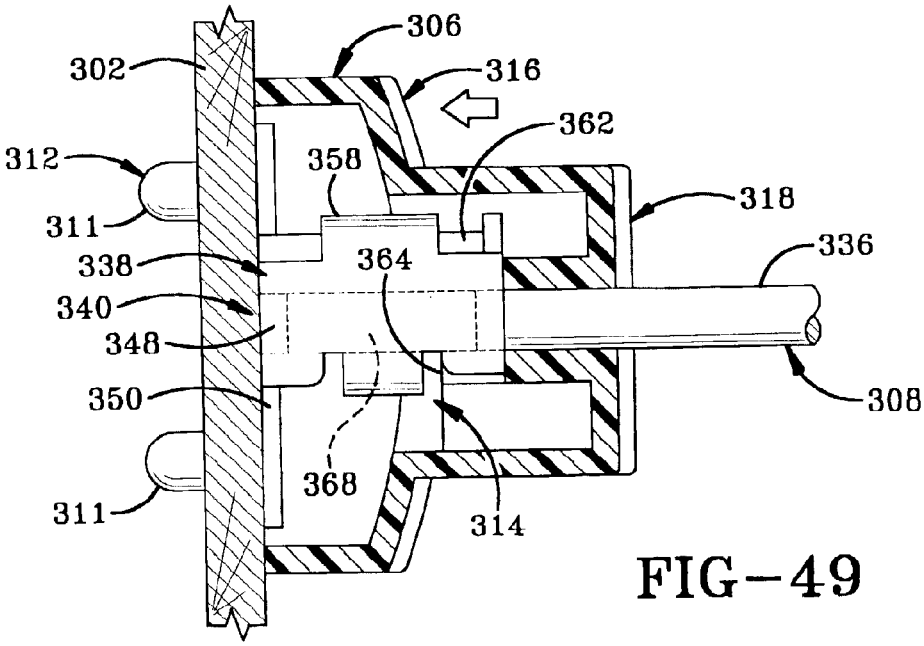
FIG. 49 is a sectional view taken on line 49—49 of FIG. 48.
Figure 50:
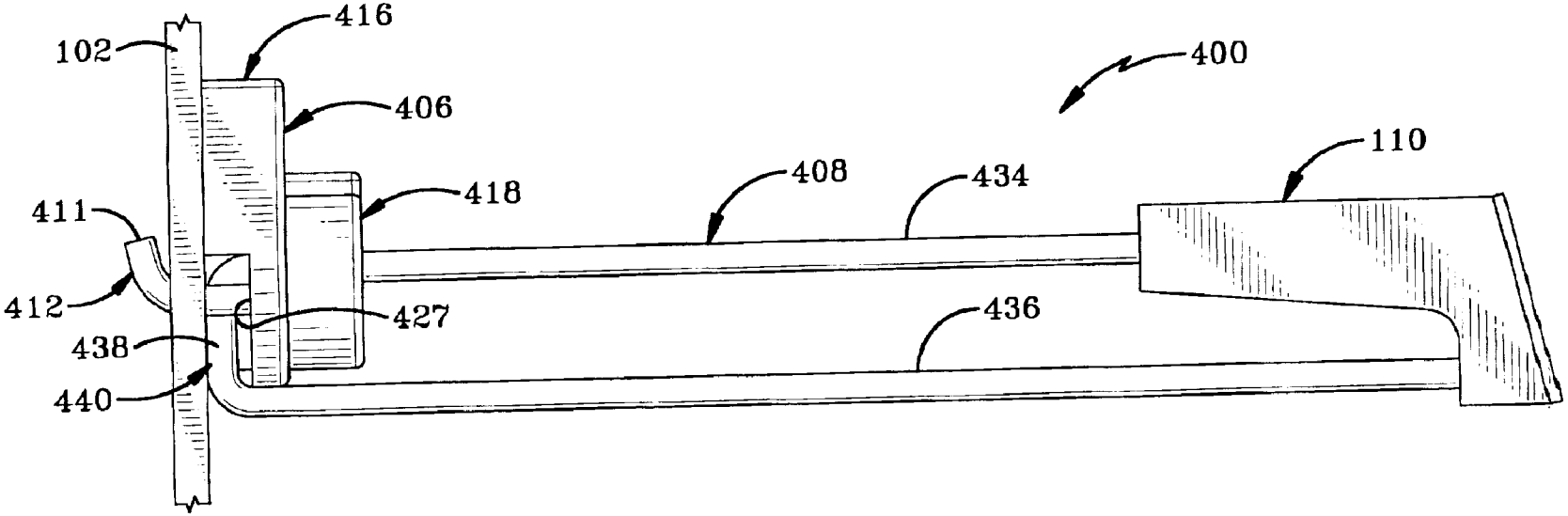
FIG. 50 is a side elevational view of a fourth embodiment of the present invention in the locked position of the base assembly.

As in the first embodiment, to allow display hook 300 to angle upwardly to insert ends 311 through holes 303, base assembly 306 must be moved outwardly from hook 312. Display hook 300 permits this outward movement because base assembly 306 in an unlocked position may slide outwardly along rod assembly 308, as shown in FIG. 28. Once hook 312 is inserted through holes 303 and display board 302, as shown in FIG. 29, rod assembly 308 extends generally horizontally outwardly from display board 302 with inner wall 350 of housing 338 abutting display board 102. To lock display hook 300 to display board 302, base assembly slides inwardly (FIG. 30) toward display board 302 into a locked position, as shown in FIG. 45. The locked position of locking mechanism 310 is also shown in FIG. 46 and functions in the same manner as described regarding display hook 100.

In accordance with the present invention, when locking mechanism 310 of base assembly 306 is in the unlocked position and base assembly 306 is slid a short distance outwardly from hook 312, lower rod 336 may rotate between a loading position and an anti-sweeping position. The anti-sweeping position is shown in FIGS. 39–40. In the anti-sweeping position, portion 344 and tip 346 of lower rod 336 extend upwardly toward upper rod 334, thus preventing a rapid removal of items 304 of merchandise as further described in relation to display hook 200. In the loading position (FIGS. 29, 30 and 38), lower rod 336 is rotated approximately 90 degrees from the anti-sweeping position. In the anti-sweeping position, portion 344 and tip 346 lie substantially in a vertical plane and in the loading position, they lie in a substantially horizontal plane.

In conjunction with horizontal slot 307 of package 305, the substantially horizontal position of portion 344 and tip 346 in the loading position allows items 304 of merchandise to be quickly loaded onto lower rod 336. However, in the anti-sweeping position, portion 344 and tip 346 are in the substantially vertical plane which prevents items 304 from being removed or loaded easily from lower rod 336. Items 304 of merchandise can only be removed quickly over the end of lower rod 336 when slot 307 is aligned with the plane along which portion 344 and tip 346 lie. Upper rod 334 interferes with the rotation of item 304 about lower rod 336, as the upper portion of package 305 would hit upper rod 334 in an attempt to thus rotate package 305. Thus, in the anti-sweeping position, slot 307 cannot be aligned vertically to allow rapid removal of items 304 of merchandise.

In accordance with the present invention, rod lock 314 functions as follows. Lower rod 336 is rotatable within holes 352 and 356 of housing 338 as well as hole 330 of base assembly 306 when locking mechanism 310 of base assembly 306 is in the unlocked position and moved a short distance outwardly from hook 312 to disengage rod lock 314, as described below. Projection 368 prevents lower rod 336 from being removed outwardly from housing 338 due to an interference between projection 368 and outer wall 338 when such removal is attempted. Inward movement of lower rod 336 is likewise prevented by a similar interference between projection 368 and inner wall 350 of housing 338. When locking mechanism 310 of base assembly 306 is in an unlocked position, and rod lock 314 is disengaged, the rotational movement of lower rod 336 is limited by an interference between projection 368 and stationary stop 362 in one direction and between projection 368 and low sidewall 360 of housing 338 in the other direction. The interferences with stop 362 and low sidewall 360 correspond respectively to the anti-sweeping position and the loading position. In the unlocked position of base assembly 306 and the disengaged position at rod lock 314, the rotational movement of lower rod 336 is limited to approximately 90 degrees of rotation. In the locked and engaged positions, the rotational movement of lower rod 336 is still limited by stationary stop 362 in one direction but limited in the other direction by moveable stop 364 of base assembly 306. More specifically, when base assembly 306 is slid inwardly toward inner end 340 of rod assembly 308, stationary stop 362 and moveable stop 364 are positioned to prevent the rotation of lower rod 336 as projection 368 abuts one of stops 362 and 364 when rotation is attempted. Lower rod 336 must be in the anti-sweeping position in order for base assembly 306 to slide into the locked position. This is due to the fact that in the loading position of rod 336, projection 368 will prevent base assembly 306 from sliding inwardly as moveable stop 364 engages with projection 368. When base assembly 306 is locked, lower rod 336 remains in the anti-sweeping position.

Display hook 300 thus provides a rod assembly 308 which attaches to a display board 302 and may be locked into a display position by base assembly 306 which slides along rod assembly 308. Further, in the unlocked position of base assembly 306 and disengaged position of rod lock 314, lower rod 336 is rotatable between a loading position and an anti-sweeping position wherein items 304 of merchandise may be quickly loaded or removed in the loading position but may not be rapidly removed in the anti-sweeping position.

A fourth embodiment of the present invention is indicated generally at numeral 400 and is shown in FIGS. 50–57. Display hook 400 is used with a display board 102 to support items 104 (as shown in the first embodiment) of merchandise for display in the retail environment. Display hook 400 includes end assembly 110, described earlier, although any of the end assemblies or anti-sweeping configurations described herein may be used with display hook 400. Display hook 400 also includes base assembly 406, rod assembly 408 and hook 412. Rod assembly 408 is similar to rod assembly 108 of the first embodiment, except that rod assembly 408 does not include a notch like notch 142 adjacent inner end 140 of rod assembly 108. Rod assembly 408 includes an upper rod 434 and a lower rod 436 joined by a connecting rod 438 adjacent an inner end 440 of rod assembly 408.

Figure 53:
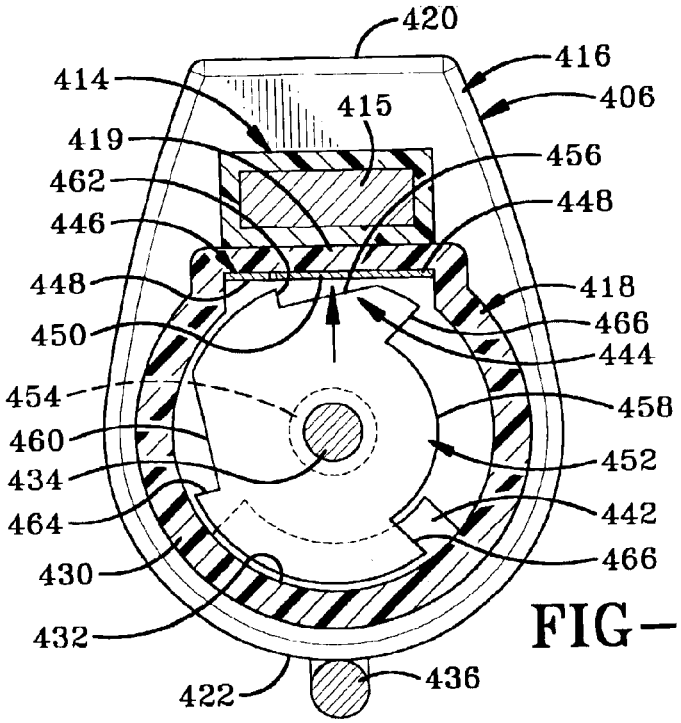
FIG. 53 is similar to FIG. 52 except a magnetic key is shown and the locking mechanism is unlocked.

Lockable base assembly 406 selectively secures display hook 400 to display board 102 in a manner that prevents display hook 400 from being removed from display board 102 without the use of a specific key 414 (FIG. 53). Display board 102 includes a plurality of holes 103, as shown in FIG. 9 related to the first embodiment. Hook 412 includes a pair of upwardly extending ends 411. Key 414 includes a magnet 415.

Figure 51:
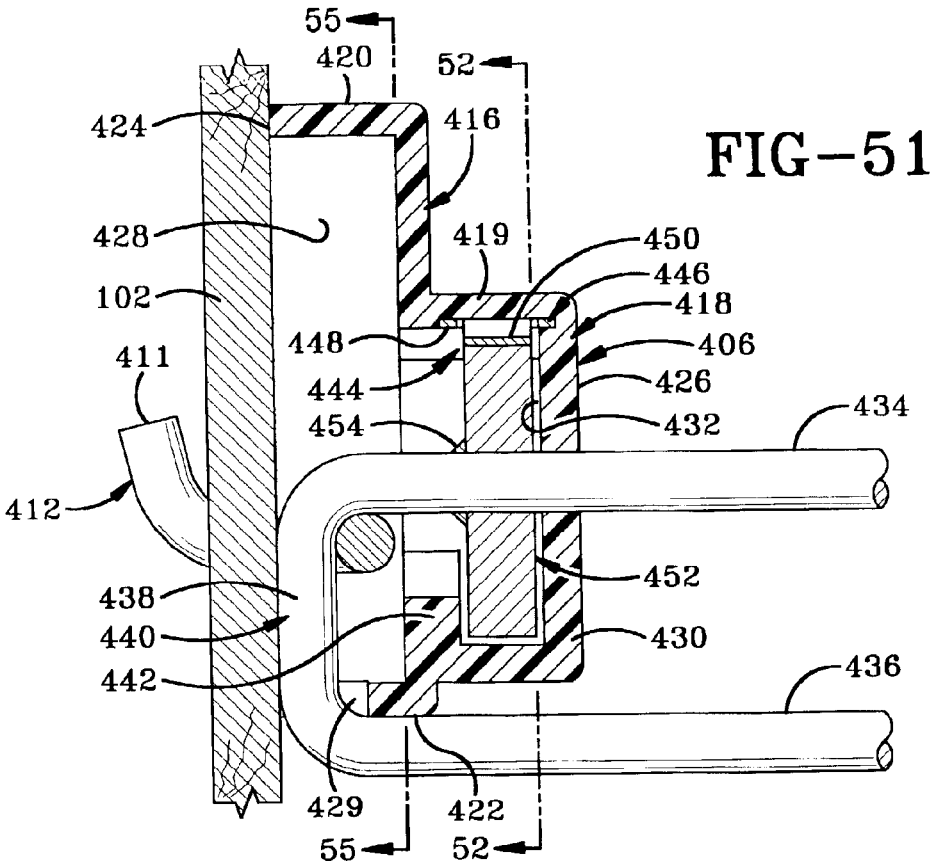
FIG. 51 is a fragmentary sectional view taken from the side showing the base assembly in a locked position.
Figure 52:
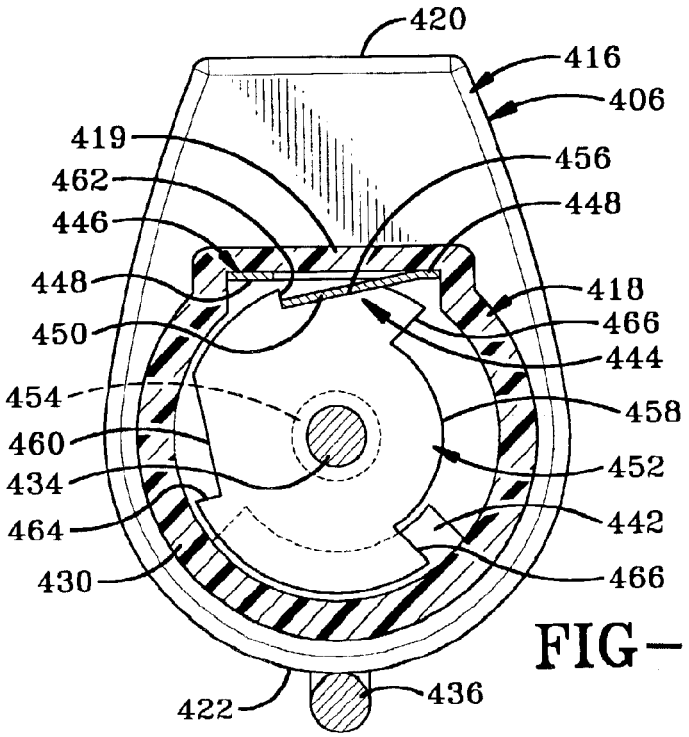
FIG. 52 is a sectional view taken along line 52—52 of FIG. 51.

Base assembly 406 includes a foot 416 and a leg 418 extending outwardly therefrom. Base assembly 406 includes an upper end 420, a lower end 422, an inner end 424, and an outer end 426. As seen in FIG. 51, base assembly 406 defines an opening 428 extending from inner end 424 toward outer end 426. A portion of leg 418 of base assembly 406 constitutes a bracket housing 430 defining an interior chamber adjacent outer end 426, interior chamber 432 communicating with opening 428. Foot 416 of base assembly 406 defines a slot 427 (FIGS. 50 and 55) adjacent inner end 424 and lower end 422. Slot 427 extends along a lower lateral quadrant of foot 416 and communicates with an opening 428. Base assembly 406 includes a lower stop 429 and a lateral stop 431, each of which bound opposed ends of slot 427. Base assembly 406 further includes an upwardly extending arcuate projection 442 at the confluence of foot 416 and leg 418 adjacent lower end 422. Projection 442 narrows opening 428 adjacent interior chamber 432. As seen in FIG. 52, leg 418 is substantially circular with upper wall 419 being substantially flat.

A locking mechanism 444 is disposed in interior chamber 432 adjacent upper wall 419. Locking mechanism 444 includes a spring element 446 having a base 448 and a finger 450 angling outwardly from base 448. Spring element 446 is similar to spring element 162 of the first embodiment.

A bracket 452 is fixedly connected to upper rod 434 by a weld 454 or any suitable means known in the art. Bracket 452 extends radially outwardly from upper rod 434. Bracket 452 is generally circular, being modified with inwardly extending notches formed therein. The notches include a locking notch 456, an arcuate channel 458 and a by-pass 460. Bracket 452 includes a ledge 462 bounding one end of locking notch 456, a ledge 464 bounding one end of by-pass 460 and a pair of end ledges 466 bounding respective ends of arcuate channel 458. Bracket 452 is disposed in interior chamber 432.

Figure 54:
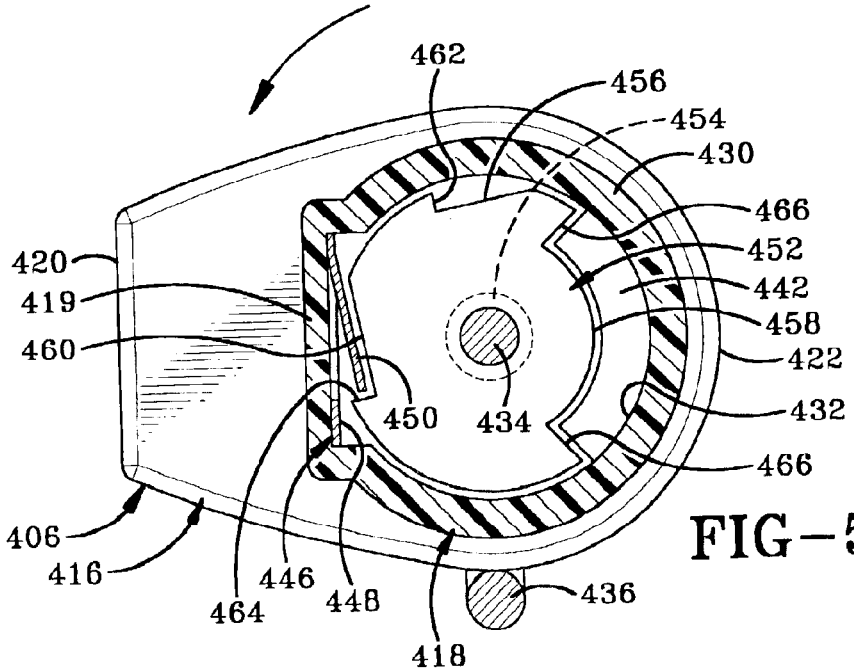
FIG. 54 is similar to FIG. 52 except the base assembly is rotated approximately 90 degrees into the unlocked position of the base assembly.

In the locked position of base assembly 406, finger 450 of spring element 446 extends into locking notch 456 and engages ledge 462 (FIGS. 51–52). In the unlocked position of locking mechanism 444, finger 450 is disposed outside of locking notch 456 (FIG. 53). In the unlocked position of base assembly 406, finger 450 lies within by-pass 460 and arcuate projection 442 is aligned with arcuate channel 458 (FIG. 54).

In operation, in accordance with one of the main features of the invention, base assembly 406 rotates about upper rod 434 between the locked position and unlocked position of base assembly 406. In the locked position, base assembly 406 prevents display hook 400 from being removed from display board 102. In the unlocked position of base assembly 406, base assembly 406 may be slid outwardly along rod assembly 408, thus allowing display hook 400 to be removed from display board 102, as described in the first embodiment of the invention.

More specifically, as noted above, finger 450 of spring element 446 is disposed within locking notch 456 and engages ledge 462 to prevent the rotation of base assembly 406 about upper rod 434 in one direction when locking mechanism 444 is in the locked position.

Figure 55:
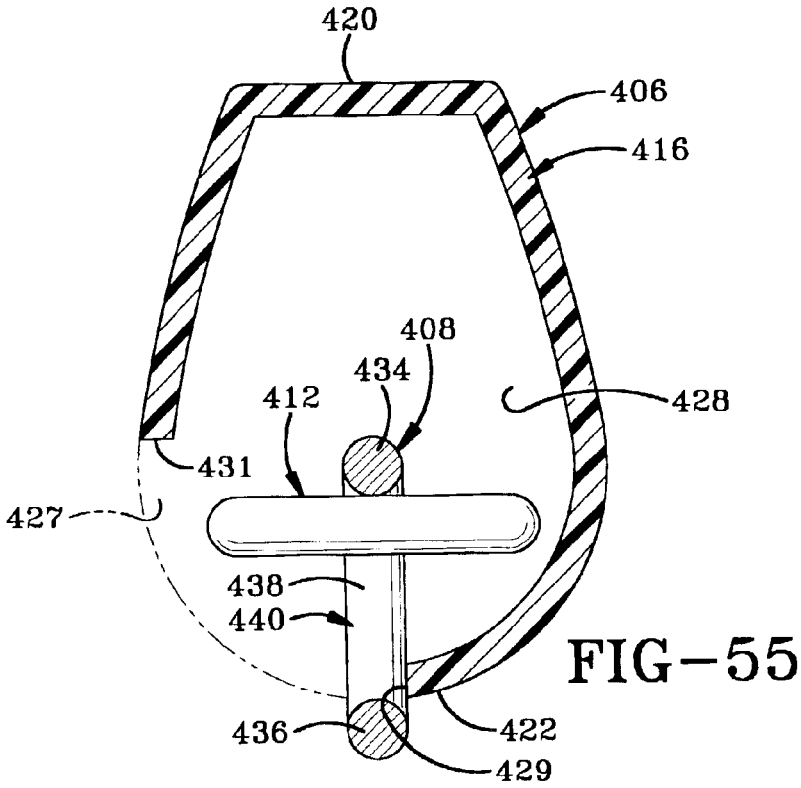
FIG. 55 is a sectional view taken along line 55—55 of FIG. 51.
Figure 56:
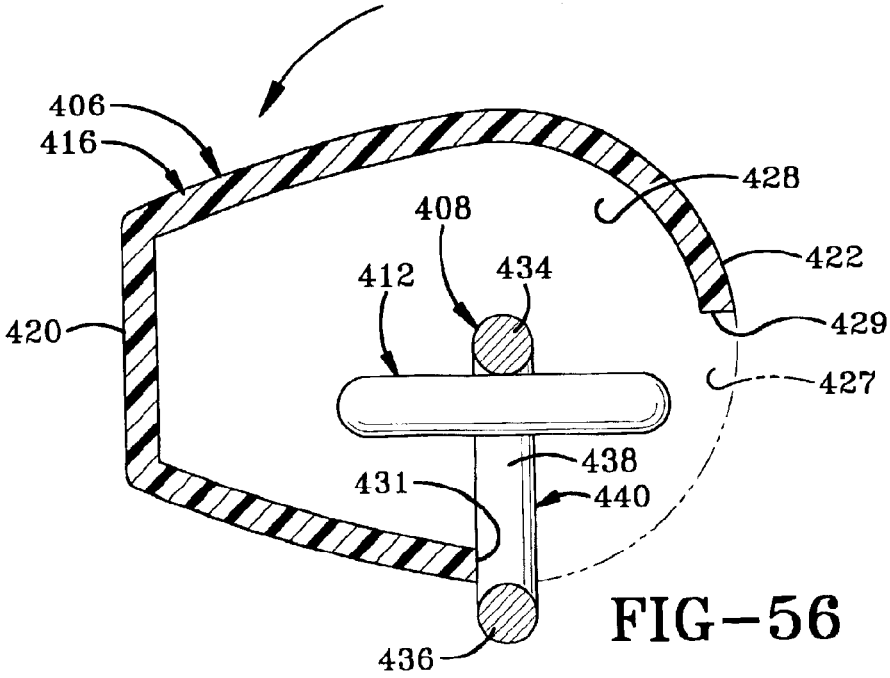
FIG. 56 is similar to FIG. 55 except that the base assembly is rotated into the unlocked position.
Figure 57:
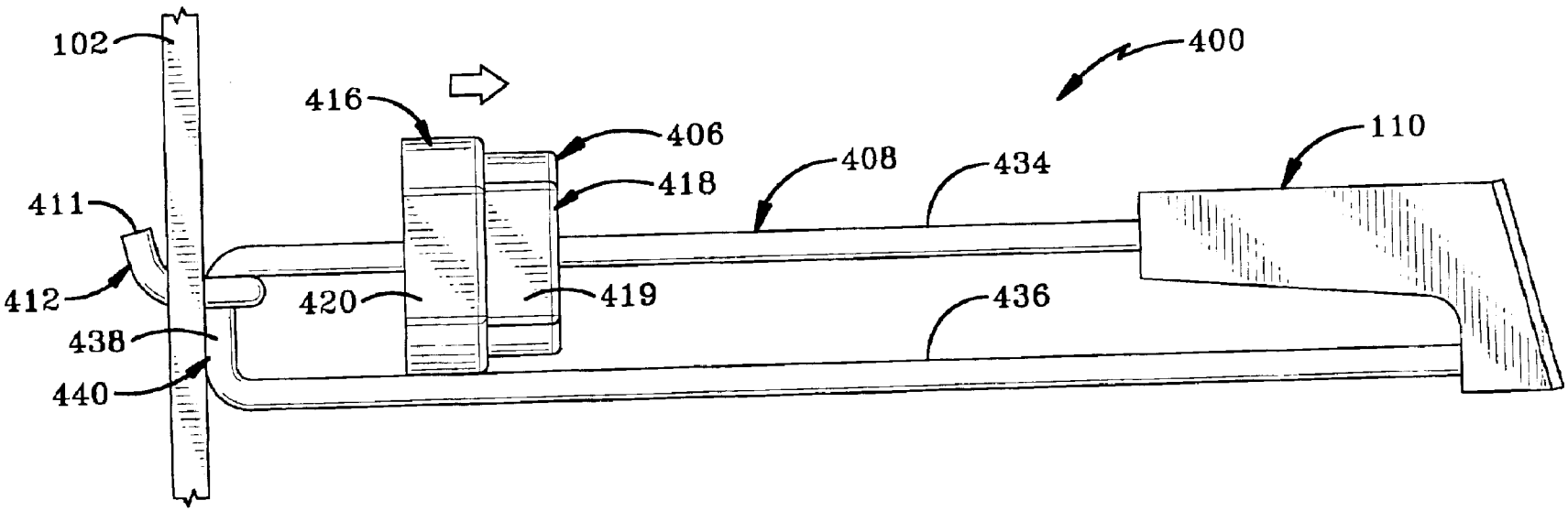
FIG. 57 is a side elevational view of the fourth embodiment with the base assembly slid outwardly along the rod assembly.

In the locked position of base assembly 406, lower stop 429 engages rod assembly 408 to prevent rotation of base assembly 406 in the opposite direction (FIG. 55). To unlock locking mechanism 444, magnetic key 414 is placed above spring element 446 to draw finger 450 out of notch 456 (FIG. 53). In the locked position (FIG. 52) and when locking mechanism 444 is first unlocked (FIG. 53), arcuate projection 442 is disposed adjacent a lower portion of bracket 452 so that base assembly 406 cannot be moved outwardly along rod assembly 408. Once locking mechanism 444 has been unlocked, base assembly 406 is rotated approximately 90 degrees into the unlocked position of base assembly 406, as shown in FIG. 54. In this unlocked position, arcuate projection 442 aligns with arcuate channel 458 and finger 450 of spring element 446 aligns with by-pass 460, allowing base assembly 406 to be moved outwardly along rod assembly 408. By-pass 460 is situated so that when finger 450 of spring element 446 is disposed therein, arcuate projection 442 is aligned with arcuate channel 458. While this facilitates said alignment, bracket 452 could be formed without bypass 460 and magnet 414 could remain adjacent upper wall 419 in order to keep finger 450 drawn outwardly, thus preventing interference between finger 450 and bracket 452 and allowing the outward movement of base assembly 406, as shown in FIG. 57. While engagement of finger 450 and ledge 464 bounding bypass 460 may serve to limit the rotation of base assembly 406, this rotation is also limited by lateral stop 431 as it engages rod assembly 408.

It will be appreciated that a variety of alterations may be made to display hook 406 without departing from the spirit of the invention. The key aspect of base assembly 406 is the incorporation of a locking mechanism which requires base assembly 406 to be rotated before being slid outwardly along rod assembly 408. Various configurations of locking mechanisms as well as the means to prevent outward movement of a base assembly along the rod assembly may be utilized. Another option incorporating a rotational movement is to have a portion of the base assembly rotate with respect to another portion of the base assembly in order to unlock the base assembly and allow it to move outwardly along the rod assembly.

Thus, merchandise display hook 400 provides a display hook which both locks to display board 102 via a lockable base assembly 406 and includes an end assembly 110 which locks to rod assembly 408 to prevent removal of items 104 of merchandise when in a locked position. Display hook 400 thus prevents a potential shoplifter from removing items 104 of merchandise from display hook 400 or removing display hook 400 from a display board 102.

In the foregoing description, certain terms have been used for brevity, clearness, and understanding. No unnecessary limitations are to be implied therefrom beyond the requirement of the prior art because such terms are used for descriptive purposes and are intended to be broadly construed.

Moreover, the description and illustration of the invention is an example and the invention is not limited to the exact details shown or described.

What is claimed is:

1. A merchandise display hook used to display items of merchandise from a display board; the merchandise display hook comprising:

a rod adapted to attach to a display board;

a base assembly connected to the rod and movable between locked and unlocked positions; the base assembly sliding with respect to the rod between the locked and unlocked positions; the locked position of the base assembly adapted to prevent the rod from being removed from the display board;

a lock movable between locked and unlocked positions; the lock being carried by one of the base and rod; the lock extending between the base and rod when the base and lock are in locked positions; and the lock being movable from the locked position to the unlocked position with a special key.

2. The merchandise display hook as defined in claim 1 wherein the lock is in the form of a spring element carried by the base; the spring element being biased toward the rod.

3. The merchandise display hook as defined in claim 2 wherein the rod defines a notch and wherein a portion of the spring element is disposed within the notch when the base is in the locked position.

4. The merchandise display hook as defined in claim 2, further comprising a strengthening element connected to the spring element.

5. The merchandise display hook as defined in claim 1, wherein the lock is unlocked with magnetic force.

6. The merchandise display hook as defined in claim 1, further comprising a key adapted to unlock the lock; the key being held by the base when the key is holding the lock in an unlocked condition.

7. The merchandise display hook as defined in claim 6, wherein the key latches to the base to allow the key to be used to move the base from the locked position to the unlocked position.

8. The merchandise display hook as defined in claim 1, further comprising an end assembly lockably connected to the rod assembly to prevent removal of items of merchandise from the rod assembly when the end assembly is in a locked position.

9. The merchandise display hook as defined in claim 8, wherein the end assembly is removably connected to the rod assembly.

10. The merchandise display hook as defined in claim 1, wherein the rod may be pivoted between loading and anti-sweeping positions when the base is in the unlocked position.

11. The merchandise display hook as defined in claim 10, wherein the loading and anti-sweeping positions are 90 degrees from one another.

12. A merchandise display hook for displaying items of merchandise on a display board, the display hook comprising:

a base having locked and unlocked positions;

a first rod extending from the base;

the first rod adapted to display items of merchandise; and the first rod capable of being pivoted between loading and anti-sweep positions when the base is in the unlocked position.

13. The merchandise display hook as defined in claim 12, wherein the loading and anti-sweeping positions are 90 degrees from one another.

14. The merchandise display hook as defined in claim 12, further comprising a lock that locks the base directly to the first rod.

15. A merchandise display hook for displaying items of merchandise on a display board, the display hook comprising:

first and second rods having inner ends and distal ends, said first rod being formed with at least one notch;

an end assembly slidably and lockably connected to the first rod at the distal end of the first rod;

a lock disposed between the end assembly and the first rod; the lock including a magnetically attractable metal finger biased toward locking engagement in the notch of the first rod and movable between locked and unlocked positions; the locked position of the lock locking the end assembly to the first rod; and the end assembly engaging the second rod when the end assembly is in the locked position; the locked position of the end assembly preventing items of merchandise from being removed from the second rod.

16. The merchandise display hook as defined in claim 15, wherein the end assembly is removable from the first rod when the lock is in the unlocked position.

17. A merchandise display hook for displaying items of merchandise on a wire display rack having horizontal and vertical wires, said display hook comprising:

a hook adapted to attach to one of the horizontal wires of the wire display rack;

a rod assembly attached to and extending outwardly from the hook; and a base assembly lockably connected to the rod assembly and adapted to engage the wire display rack to selectively prevent removal of the hook and rod assembly from the wire display rack.

18. The merchandise display hook as defined in claim 17, wherein the hook includes a pair of outwardly extending spaced claws and a tongue extending away from the claws; the claws being adapted to attach to the said one of the horizontal wires of the wire display rack and the tongue being adapted to abut a horizontal wire below the said one horizontal wire when the display hook is attached to the wire display rack.

19. The merchandise display hook as defined in claim 17 wherein the base assembly is lockably connected to the rod assembly by a magnetically attractable spring element.

20. The merchandise display hook as defined in claim 19 wherein the rod assembly includes at least one rod extending substantially horizontally outwardly from the base assembly; and in which a notch is formed in the rod and the spring element is receivable in said notch when the base assembly is lockably connected to the rod assembly.

21. The merchandise display hook as defined in claim 20 wherein the base assembly is slidably mounted on the rod and moveable between locked and unlocked positions with respect to the wire display rack.

22. The merchandise display hook as defined in claim 20 wherein the rod assembly includes a second rod extending generally parallel with and spaced from the said one rod.

23. The merchandise display hook as defined in claim 15 wherein the end assembly includes a projection extending into said one notch in the first rod to prevent removal of the end assembly from said first rod when the lock is in the unlocked position.

24. A merchandise display hook for displaying items of merchandise on a display board, the display hook comprising:

first and second rods having inner ends and distal ends;

an end assembly slidably and lockably connected to the first rod at the distal end of the first rod;

a lock disposed between the end assembly and the first rod; the lock including a magnetically attractable member engageable with the first rod and movable between locked and unlocked positions; the locked position of the lock locking the end assembly to the first rod; and the distal end of the second rod being received in an opening formed in the end assembly when the end assembly is in the locked position, preventing items of merchandise from being removed from the second rod, said distal end being formed with a non-circular engaging surface to prevent rotation of the end assembly with regard to the first and second rods when the distal end of the second rod is received in the end assembly opening.

* * * * *